US008590608B2

(12) United States Patent
Linn et al.

(10) Patent No.: US 8,590,608 B2
(45) Date of Patent: Nov. 26, 2013

(54) METHOD AND APPARATUS FOR MULTILATERAL CONSTRUCTION AND INTERVENTION OF A WELL

(76) Inventors: Bryan Charles Linn, Pearland, TX (US); David J. Speller, Houston, TX (US)

( * ) Notice: Subject to any disclaimer, the term of this patent is extended or adjusted under 35 U.S.C. 154(b) by 180 days.

(21) Appl. No.: 13/162,072

(22) Filed: Jun. 16, 2011

(65) Prior Publication Data

US 2012/0261130 A1 Oct. 18, 2012

Related U.S. Application Data

(60) Provisional application No. 61/476,065, filed on Apr. 15, 2011, provisional application No. 61/344,235, filed on Jun. 16, 2010.

(51) Int. Cl.
*E03B 3/11* (2006.01)

(52) U.S. Cl.
USPC ..... 166/50; 166/381; 166/117.5

(58) Field of Classification Search
USPC ..... 166/313, 50, 255.3, 381, 117.5; 175/61, 175/81, 82
See application file for complete search history.

(56) References Cited

U.S. PATENT DOCUMENTS

| | | | | |
|---|---|---|---|---|
| 3,799,259 | A | 3/1974 | Dinning | |
| 6,209,644 | B1 | 4/2001 | Brunet | |
| 2002/0079102 | A1 | 6/2002 | Dewey et al. | |
| 2002/0108754 | A1 * | 8/2002 | Hess et al. | 166/313 |
| 2004/0149452 | A1 * | 8/2004 | Pendleton | 166/381 |

* cited by examiner

*Primary Examiner* — David Bagnell
*Assistant Examiner* — Taras P Bemko
(74) *Attorney, Agent, or Firm* — Welsh Flaxman & Gitler LLC

(57) ABSTRACT

A multilateral access system for a multilateral well including a main well bore and at least one lateral well bore includes a tubular workstring having an inner string and an outer string. The outer string includes a diverter body having a cylindrical housing with a lateral window, the diverter body being shaped and dimensioned to direct the inner string the lateral window and into the at least one lateral well bore. The system is used by positioning the tubular workstring within a multilateral bore. The method further includes positioning the diverter body such that the window of the diverter body faces a milled casing window of the lateral well bore and moving the inner string upwardly above the diverter body. Subsequently, the inner string is lowered back though the diverter body, wherein the diverter body exerts a lateral force on a lower end of the inner string urging the lower end of the inner string toward the milled casing window.

13 Claims, 24 Drawing Sheets

Section A-A

METHOD AND APPARATUS FOR MULTILATERAL CONSTRUCTION AND INTERVENTION OF A WELL

CROSS REFERENCE TO RELATED APPLICATIONS

This application claims the benefit of U.S. Provisional Patent Application Ser. No. 61/476,065, entitled "METHOD AND APPARATUS FOR MULTILATERAL CONSTRUCTION AND INTERVENTION OF A WALL", filed Apr. 15, 2011, and U.S. Provisional Patent Application Ser. No. 61/344,235, entitled "METHOD AND APPARATUS FOR MULTILATERAL ONE TRIP INTERVENTION OF A WELL", filed Jun. 16, 2010.

BACKGROUND OF THE INVENTION

For more than the past decade, multilateral wells have become increasingly popular. These wells increase the accessibility to formation reserves in oil and gas production fields. A multilateral well is constructed by drilling a main well bore and then drilling branch well bores, or lateral well bores, off of the main well bore into different producing regions of the reservoir. Once drilled, the multilateral well resembles a branch of a fern with lateral branches directed off of the main well bore or stem. These multilateral branch well bores are known to be drilled in both vertical wells and horizontal wells. The primary advantage of multilateral well construction is the ability to drain a much larger portion of the hydrocarbon bearing reservoir with a single well bore from the surface.

Drilling the lateral "legs", or branch well bores, off of the main well bore commonly requires a device called a whipstock. A whipstock is a long wedge shaped tool that attaches to the well casing and forces or directs the drill string away from the centerline of the main well bore in order to create the lateral well bore. Prior to drilling the lateral or branch well bore, the whipstock is run into the hole and locked in place in the main well bore. The whipstock has an angled face oriented to direct the drill bit in a specific direction off the main well bore where one desires to form the lateral or branch well bore. First, the whipstock directs a special mill to create a "window" or "milled casing window" through the side of the casing of the main well bore. The next step is to go back with a drill bit to complete the lateral or branch well bore through the window. After drilling the lateral well bore, the whipstock is retrieved from the well leaving the main well bore and lateral well bore(s) open.

If re-entry to the lateral well bore is required, the whipstock is typically located in place in the main well bore, and used therein, using an "orienting collar" positioned in the original casing string. The orienting collar ensures that the whipstock will relocate at the exact place and orientation on subsequent runs.

Multiple lateral or branch well bores may be drilled using the same method, each requiring an orienting collar which is positioned in the main well bore so that the whipstock can be positioned and oriented where each lateral well bore is to be drilled. Prior to running the casing string, the orienting collars must be "timed", that is, properly circumferentially oriented within the main well bore, so that the lateral well bores are drilled in the preferred directions relative to each other.

After the lateral well bore(s) are drilled, the multilateral well will have a main well bore and lateral(s) or branch well bore(s) drilled off of the main well bore. There will be a need to reenter each of the well bores at a later date in order to provide "intervention" services such as fracturing, stimulation or cleanout which require mechanical and pressure integrity within each well bore. Consider, for example, the process involved in order to fracture stimulate each of the bores of a multilateral well, which is a common procedure to enhance production. The workstring is first positioned into the main well bore to fracture the formation, followed by repositioning the workstring into each of the lateral well bores for fracturing each respective formation. With current technology, in order to access each respective lateral well bore, the operator must reinstall the whipstock in the predetermined position in the main well bore. When the operator wants to enter a different lateral well bore, the operator must completely pull the workstring out of the well, and reinstall the whipstock in the new position and rerun the workstring. In fact, each time the operator wants to enter a lateral well bore or the main well bore, the workstring must be removed, the whipstock must be repositioned and the workstring must be redeployed. This adds up to a considerable amount of rig time in performing these operations. In addition, companies that provide support services, such as pump companies, are standing idle waiting for these repositioning operations to complete. During this time, the operator is required to pay the ancillary service companies to stand by, or risk losing their services to another operator resulting in considerable delays in the project. As such, the well operator bears a considerable cost in order to reap the benefits of multilateral completions.

SUMMARY OF THE INVENTION

It is an object of the present invention, which is described below in detail, to provide a system, which comprises a device and associated method allowing an operator to access a main well bore and each of the lateral well bores without removing the workstring from the multilateral well. The system does not require the reinstallation of the whipstock. The system uses a built in diverter to guide the workstring into the desired lateral well bore once it has been located in the main well bore.

Using the present system results in a dramatic reduction in rig time and subsequent idle time of the support services, including eliminating some services altogether, such as the elimination of the whipstock rental and service. The system creates considerable cost savings to the operator, providing dramatically improved multilateral well economics, which opens up the possibilities of using multilateral well construction in oil and gas fields where this type well construction is currently not economical, as well as improving the economic model of viable reservoirs.

The device and associated method dramatically reduce rig time because the operation of repositioning the workstring from one bore to another may be performed without removing the workstring from the multilateral well.

The device and associated method reduce rental and downhole tool charges by eliminating the use of the whipstock to direct the workstring into the lateral well bores. Further, the device and associated method eliminate or dramatically reduce idle "standby" time of support services such as pump trucks and wireline units.

Additionally, the device and associated method allow multilateral well construction in fields where economics currently are prohibitive. This well bore construction can reduce total numbers of wellheads required to produce a field.

This is achieved by the provision of a multilateral access system for a multilateral well including a main well bore and at least one lateral well bore. The multilateral access system includes a tubular workstring having an inner string and an outer string. The outer string includes a diverter body having a cylindrical housing with a lateral window, the diverter body being shaped and dimensioned to direct the inner string the lateral window and into the at least one lateral well bore.

It is also an object of the present invention to provide a multilateral access system wherein the diverter body includes a spring device biasing the inner string toward the lateral window of the diverter body.

It is another object of the present invention to provide a multilateral access system wherein the spring device is composed of a series of leaf springs which, as the inner string passes therethrough, function to urge the inner string outward towards and through the lateral window and into the lateral well bore.

It is a further object of the present invention to provide a multilateral access system wherein the outer string includes, from top down, a support collar, a running collet, a releasing shear screw, a snap latch sub, an extension housing and the diverter body, a floating polished bore receptacle, an indexing alignment assembly with a locating key, a spacer pipe, a stop collar, a lower extension mandrel, a lower seal assembly with a sealing stack, and a rotating mule shoe assembly.

It is also an object of the present invention to provide a multilateral access system wherein the indexing alignment assembly ensures the window of the diverter body faces the same direction relative to the indexing alignment assembly as a whipstock used to create an original lateral well bore.

It is another object of the present invention to provide a multilateral access system wherein the indexing alignment assembly includes an alignment mandrel, a lock ring threadingly engaged to the alignment mandrel.

It is a further object of the present invention to provide a multilateral access system wherein the indexing alignment assembly also includes an index ring slidingly engaged to the alignment mandrel, and a key engaged with the index ring into a slot in the alignment mandrel which permits axial sliding of the index ring but prevents rotation.

It is also an object of the present invention to provide a multilateral access system wherein the indexing alignment assembly also includes an alignment body which is threadingly engaged to the alignment mandrel.

It is another object of the present invention to provide a multilateral access system wherein the inner string is comprised of, from top down, a tubular section, an anchor mandrel, a spacer joint, a floating seal mandrel with a sealing stack, and a rotating mule shoe assembly.

It is a further object of the present invention to provide a method for accessing for a multilateral well including a main well bore and at least one lateral well bore. The method includes positioning a tubular workstring including an inner string and an outer string within a multilateral bore. The outer string includes a diverter body having a cylindrical housing with a lateral window. The diverter body is shaped and dimensioned to direct the inner string through the lateral window and into the at least one lateral well bore. The method further includes positioning the diverter body such that the window of the diverter body faces a milled casing window of the lateral well bore and moving the inner string upwardly above the diverter body. Subsequently, the inner string is lowered back though the diverter body, wherein the diverter body exerts a lateral force on a lower end of the inner string urging the lower end of the inner string toward the milled casing window.

It is also an object of the present invention to provide a method further including disengaging the inner strong and the outer string.

It is another object of the present invention to provide a method further including the step of positioning the window of the diverter body in blank casing such that inner string may bypass the lateral well bore.

Other objects and advantages of the present invention will become apparent from the following detailed description when viewed in conjunction with the accompanying drawings, which set forth certain embodiments of the invention.

DETAILED DESCRIPTION OF THE INVENTION

Figures 1, 1A:
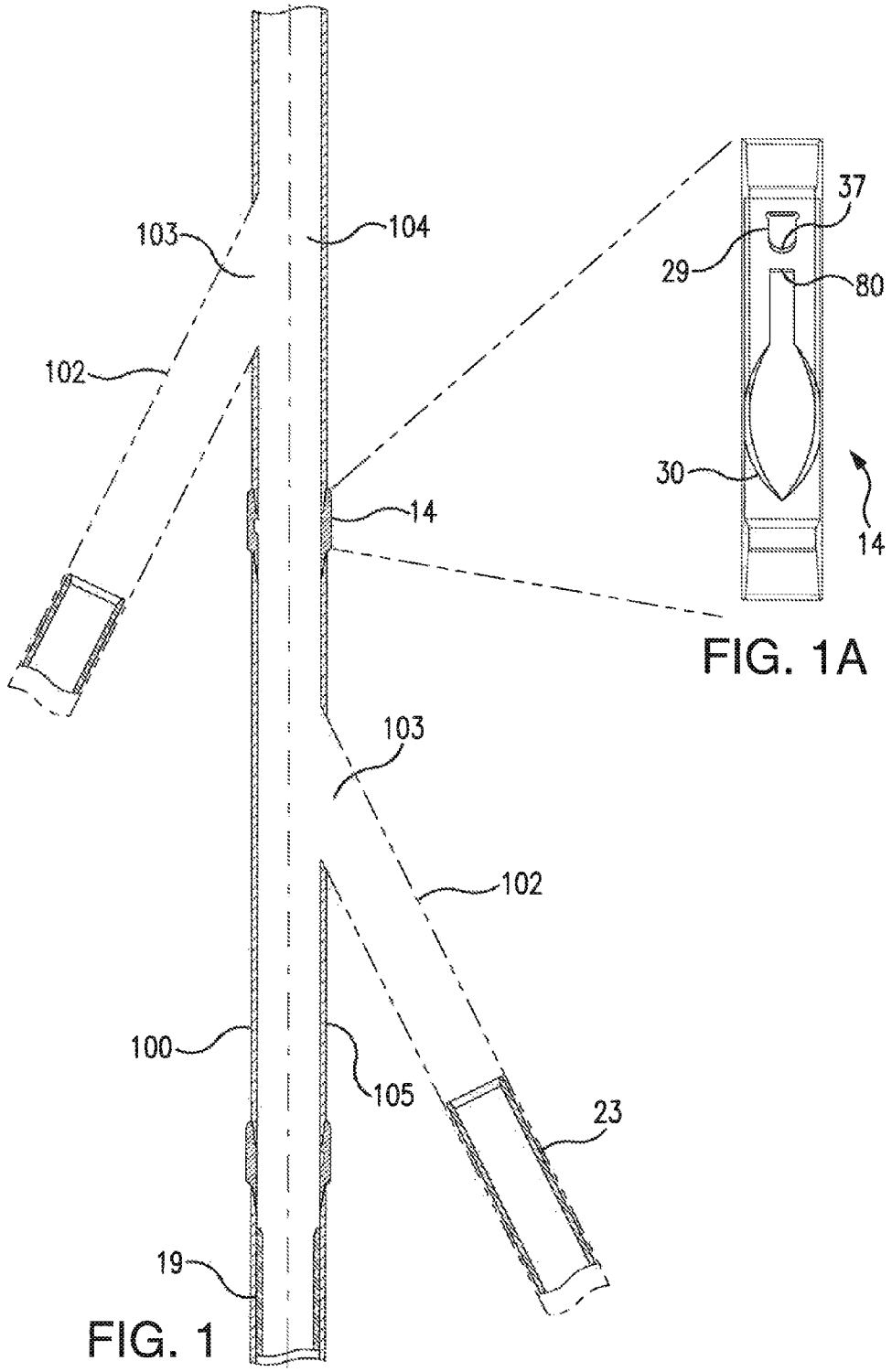
FIG. 1 is a side schematic view of a multilateral well.
FIG. 1*a* is a detailed view of the alignment collar.

The detailed embodiment of the present invention is disclosed herein. It should be understood, however, that the disclosed embodiment is merely exemplary of the invention, which may be embodied in various alternative forms. Therefore, the details disclosed herein are not to be interpreted as limiting, but merely as a basis for teaching one skilled in the art how to make and/or use the invention.

With reference to the various figures, the present invention provides a multilateral access system and several methods to enable access to a main well bore 100 and a plurality of lateral well bores 102 created by milling a window 103 through the sidewall of the main bore 100 for activities such as fracture stimulation without removing the workstring 1 from the multilateral well 104. The present multilateral access systems and associated method substantially reduce the time and cost of operations.

The multilateral access system and method may be used in a high pressure fracture stimulation operations. Fracture stimulation involves pumping solids-laden fluids at very high flow rates and extreme pressures, that is, oftentimes greater than 10,000 psi. Thus, the high pressure fracture stimulation operations require pressure integrity and full bore access (that is, no internal restrictions) throughout the workstring 1. Alternative configurations may be used for enabling access for passage of wireline tools, or well clean out tools, into each lateral well bore 102 one after the other without requiring a whipstock device or tripping the workstring 1 out of the multilateral well 104.

Figures 1, 2:
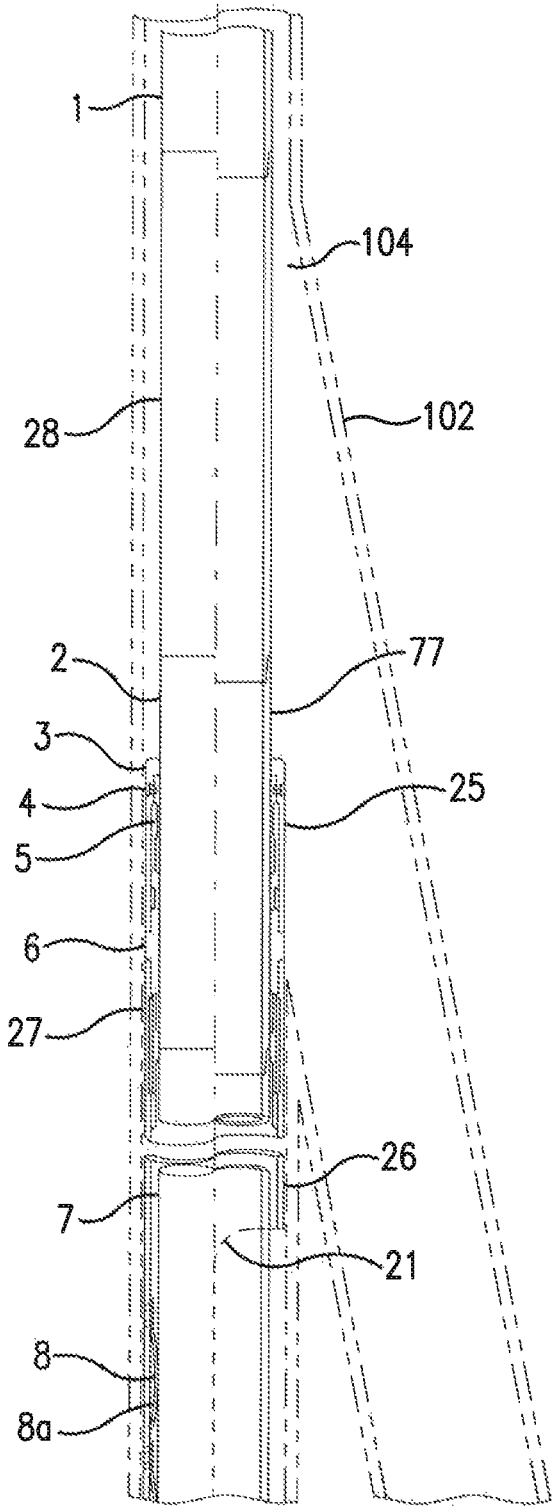
FIG. 2, which is composed of FIGS. 2-1 through 2-3, ordered from top to bottom, shows a workstring in accordance with the present invention.
Figure 2:
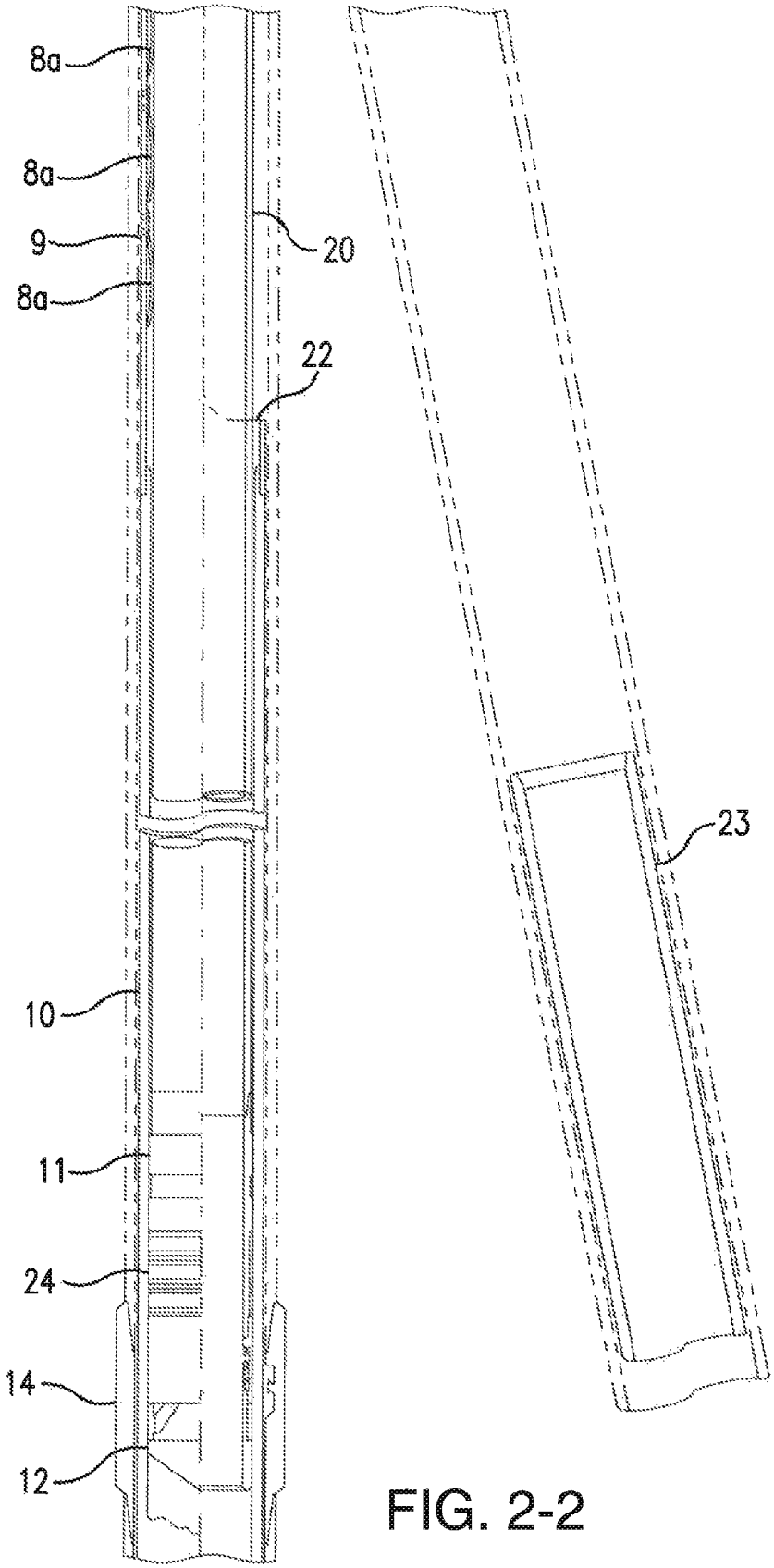
Figures 2, 3:
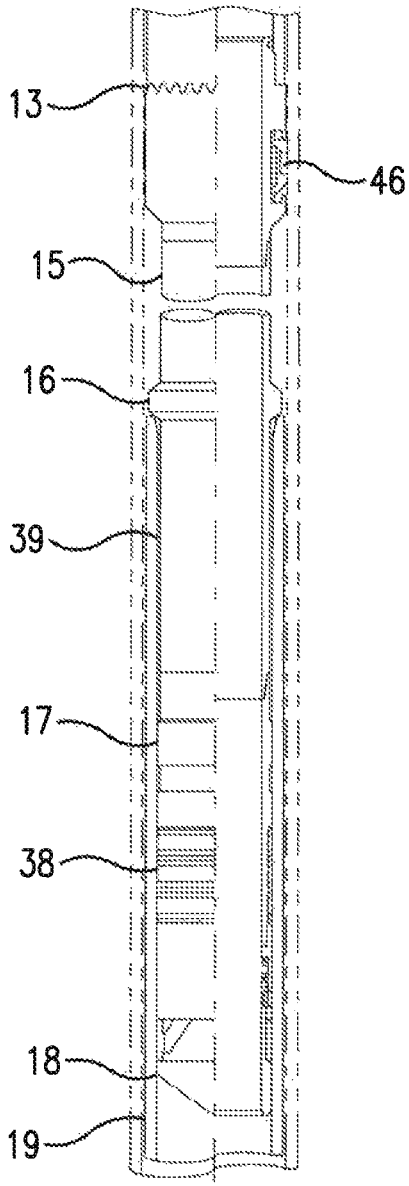

Referring to FIG. 1 and FIG. 2, the multilateral access system includes a multilayered assembly 77 in its preferred embodiment. The multilateral access assembly 77 includes from top down, a tubular workstring 1 which runs from the depths of the multilateral well 104 to the surface (not shown). It is through the tubular workstring 1 the stimulation fluids and well service tools are conveyed as desired to conduct well intervention services.

Referring to FIG. 2, the workstring 1 includes an inner string 20 and an outer string 25. The inner string 20 is comprised of, from top down, a tubular section 28, an anchor mandrel 2, a spacer joint 7, a floating seal mandrel 11 with a sealing stack 24, and a rotating mule shoe assembly 12. Although a rotating mule shoe assembly is disclosed in accordance with a preferred embodiment, it is appreciated a non-rotating mule shoe assembly may at times be used as an option.

The outer string 25 is comprised of, from top down, a support collar 3, a running collet 5, a releasing shear screw(s) 4, a snap latch sub 6, an extension housing 27 and a diverter body 9, a floating polished bore receptacle 10, an indexing alignment assembly 13 with a locating key 46, a spacer pipe 15, a stop collar 16, a lower extension mandrel 39, a lower seal assembly 17 with a sealing stack 38, and a rotating mule shoe assembly 18. In preparation for conveying into the multilateral well 104, the outer string 25 is connected outward and concentric with the inner string 20 as further described below and the floating seal mandrel 11 and sealing stack 24 are maintained in a sealing engagement with the floating polished bore receptacle 10. This enables the entire assembly of the workstring 1 to be conveyed into the multilateral well 104, to position and engage with the main well bore 100 and lateral bore(s) 102 in a proper fashion as to provide full-bore and pressure-contained access to the aforementioned main well bore 100 and lateral well bore(s) 102.

As will be discussed below in greater detail, the diverter body 9 includes a cylindrical housing 26 with a lateral window 21 (that is, an aperture) formed along a wall thereof. The window 21 has a predetermined length and radial extent necessary for the passage of the inner string 20 into lateral well bores 102 as described herein.

Figure 3A:
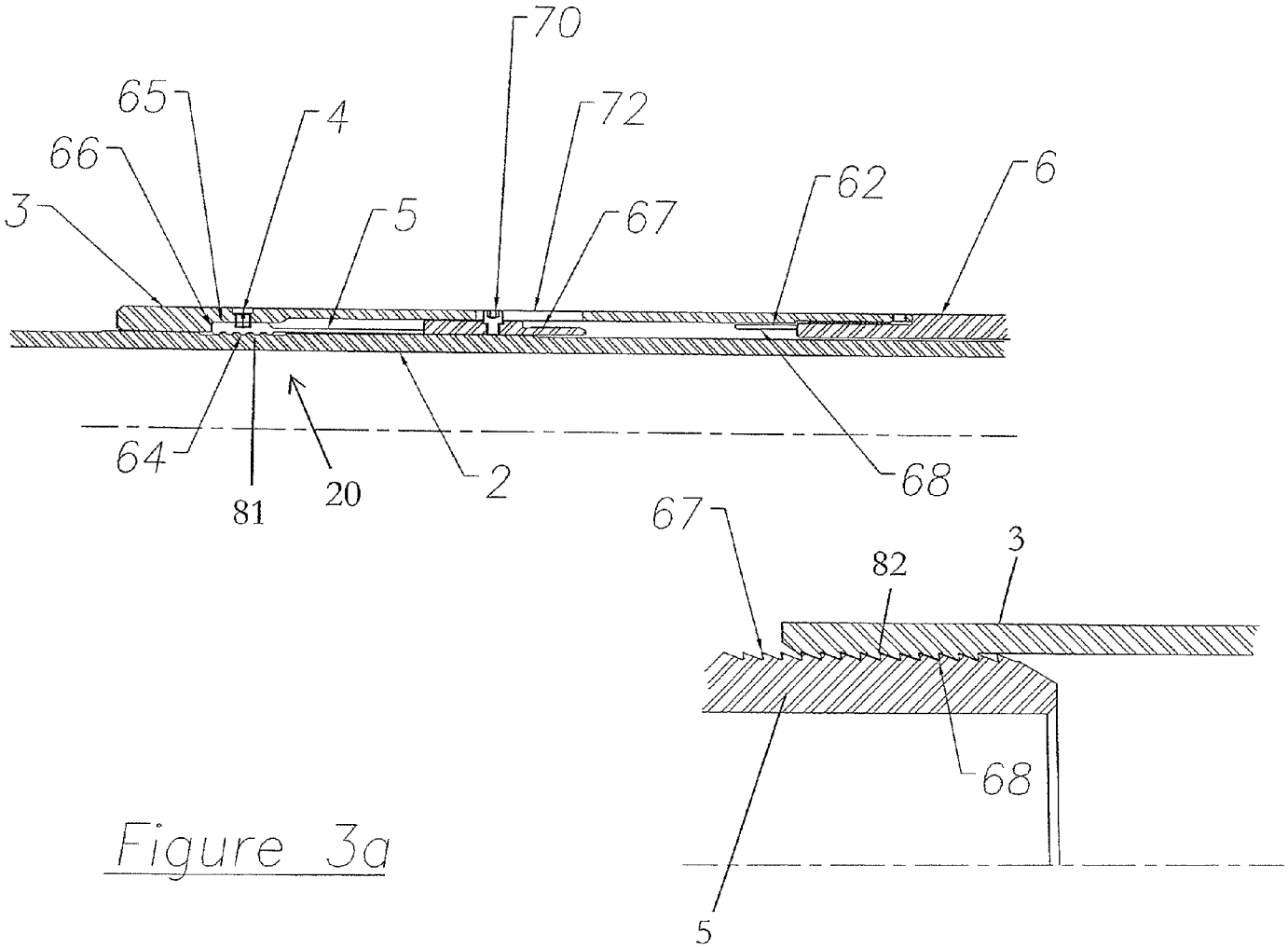
FIG. 3*a* is a detailed view of the upper and lower ends of the snap latch sub.
Figure 3B:
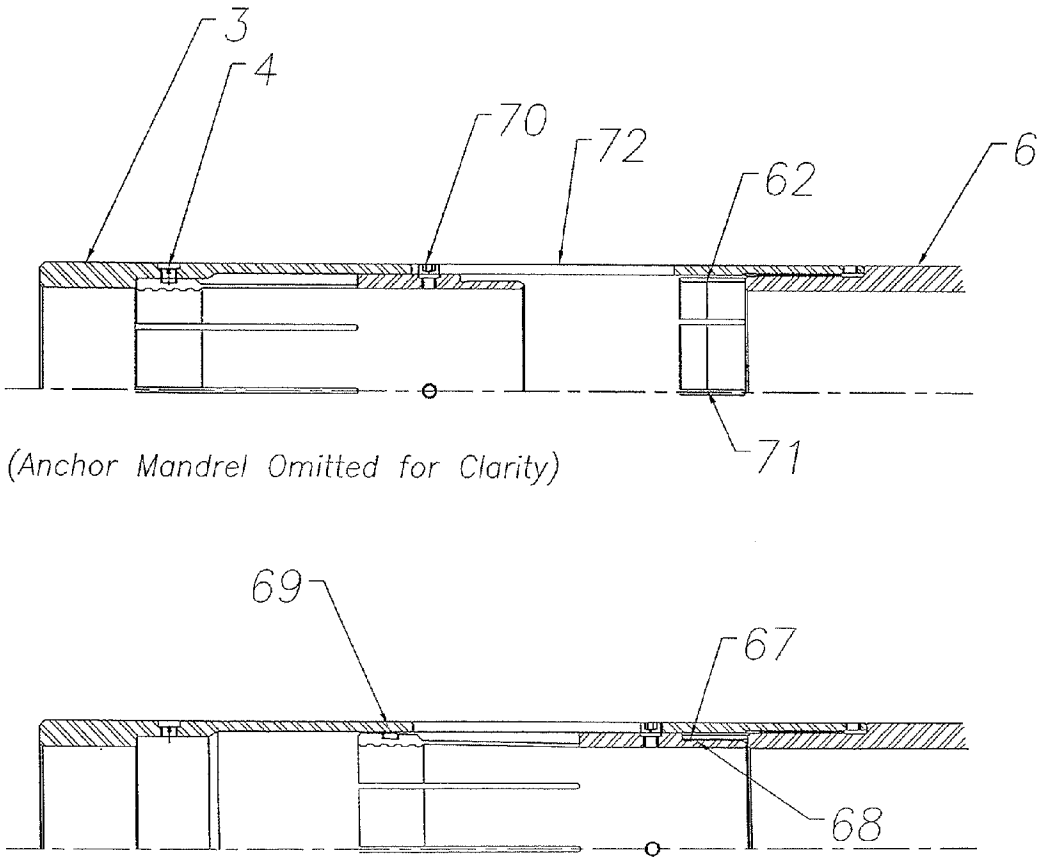
FIG. 3*b* is a detailed view showing operation of the snap latch sub.

Referring to FIG. 3*a* and FIG. 3*b*, on the outer string 25, connected to the support collar 3, is a snap latch sub 6 which includes a lockout ratchet 62 on the upper end thereof and a rotational lock in the form of detent fingers 63 on the lower end (explained below in greater detail with reference to FIG. 7*a*). The inner string 20 of the workstring 1 further includes an anchor mandrel 2 which has a threaded section (or a grooved section) 81 which the mating "teeth" 64 of the running collet 5 of the outer string 25 engage. The running collet 5 is engaged to the anchor mandrel 2 by means of a reduced inner diameter section 65 in the support collar 3, which maintains the meshing of the mating teeth 64 and the threaded section 81. The running collet 5 cannot disengage the anchor mandrel 2 because it is prevented from moving axially downward relative thereto by means of a series of release shear screws 4.

The support collar 3 has a shoulder 66 preventing the running collet 5 from moving upward, so the running collet 5 can only move downward with the workstring 1. This means that the release shear screws 4 can only release the running collet 5 when the workstring 1 moves downhole relative to the support collar 3. As long as the mating teeth 64 in the running collet 5 are engaged with the threaded section 81 of the anchor mandrel 2, and the release shear screws 4 are not sheared, the workstring 1 is connected to the support collar 3 and the two assemblies move together as one. While it is appreciated there are other commonly used shearable devices that can be substituted for the release shear screws disclosed above, such as, shear rings, shear pins, and the like, the support collar and running collet device provides a more robust connection between the inner string and outer string by not supporting the weight of the outer string on the shearable device, but rather by the mating teeth and support shoulder.

The running collet 5 has "hooked" threads or teeth 67 on the outer surface of the lower end thereof (see FIGS. 3*a* and 3*b*). At the desired time to release the inner string 20 from the outer string 25 to allow relative movement, the inner string 20 is lowered in the well to apply adequate weight to shear the shear screws 4 and permit the running collet 5 to move downward with the inner string 20 (see FIG. 3*b*). As the inner string 20 is lowered further, the running collet 5 moves along with the anchor mandrel 2 until the teeth 64 on the running collet 5 engage with the mating teeth 82 on the top end of the lockout ratchet 68 as shown in FIG. 3*a*. The teeth 82 on the top end of the lockout ratchet 68 are cut on the inside surface thereof. The lockout ratchet 68 is slotted 71 so that the teeth 67 on the running collet 5 will act as a ratchet as it travels down. Once the running collet 5 is moved down until it bottoms out on the lockout ratchet 68, the upper end which had been engaged to the anchor mandrel 2 is repositioned inside of the support collar 3 such that the collet outer diameter is de-supported and loses its engagement with the anchor mandrel 2. The hooked thread, or teeth, 82 of the lockout ratchet 68 in the snap latch sub 6 prevent the release of the running collet 5 by engaging tightly against the mating hooked threads 67 of the running collet 5 in the event that upward movement of the inner string 20 produces drag forces urging the running collet 5 upward. The running collet 5 is thus prevented from reengaging with the anchor mandrel 2 thus allowing free movement of the inner string 20 up and down in the multilateral well 104. Included in the running collet 5 are anti-rotation pin(s) 70 engaged in a slot 72 in the support collar 3 which prevents the running collet 5 from rotating, thus preventing the inadvertent release of the hooked threads 67 of the running collet 5 by "unthreading" in the event that the inner string 20 is rotated.

Referring to FIG. 2, the snap latch sub 6 is coupled to the extension housing 27 and to the diverter body 9 in which a window 21 is cut to allow the inner string 20 to traverse into the lateral well bores 102. It is appreciated that although a preferred embodiment provides that the snap latch sub is coupled to the extension body which is coupled to the diverter body, it is, however, possible to eliminate the extension body and mate the diverter body directly to the snap latch sub; the extension body was added as a matter of cost although it could theoretically be built either way.

The diverter body 9 includes a spring device composed of the diverter spring(s) 8. In accordance with a preferred embodiment, the diverter spring(s) 8 is composed of a series of leaf springs 8*a*, which, as the inner string 20 passes therethrough function to urge the inner string 20 outward towards and through the window 21 and into the lateral well bore 102. In accordance with a preferred embodiment, the diverter springs 8 are positioned along an inner wall of the cylindrical housing 26 opposite the lateral window 21 so as to divert the inner string 20 toward and through the lateral window 21 and ultimately into the lateral bore.

Below the diverter body 9 is positioned the floating polished bore receptacle 10. The floating polished bore receptacle 10 provides a pressure sealing device when used in conjunction with the floating seal mandrel 11 in the inner string 20.

The portion of the inner string 20 connected below the anchor mandrel 2 comprises a spacer joint 7 which extends below the window 21 in the diverter body 9 the length of which is determined so that the floating seal mandrel 11 is engaged into the floating polished bore receptacle 10 in order to make sealing engagement. Connected to the spacer joint 7 is the floating seal mandrel 11 which has a sealing stack 24 which provides pressure containment when used in conjunction with the floating polished bore receptacle 10. In particular, the floating seal mandrel 11 and floating polished bore receptacle 10 act together as an expansion joint. The floating polished bore receptacle 10 has a length such that the floating seal mandrel 11 can slide up and down inside the polished bore of the floating polished bore receptacle 10 while maintaining sealing capability and thus compensates for changes in workstring 1 length due to changes in pressure and temperature during well bore stimulation and intervention operations.

Figure 4:
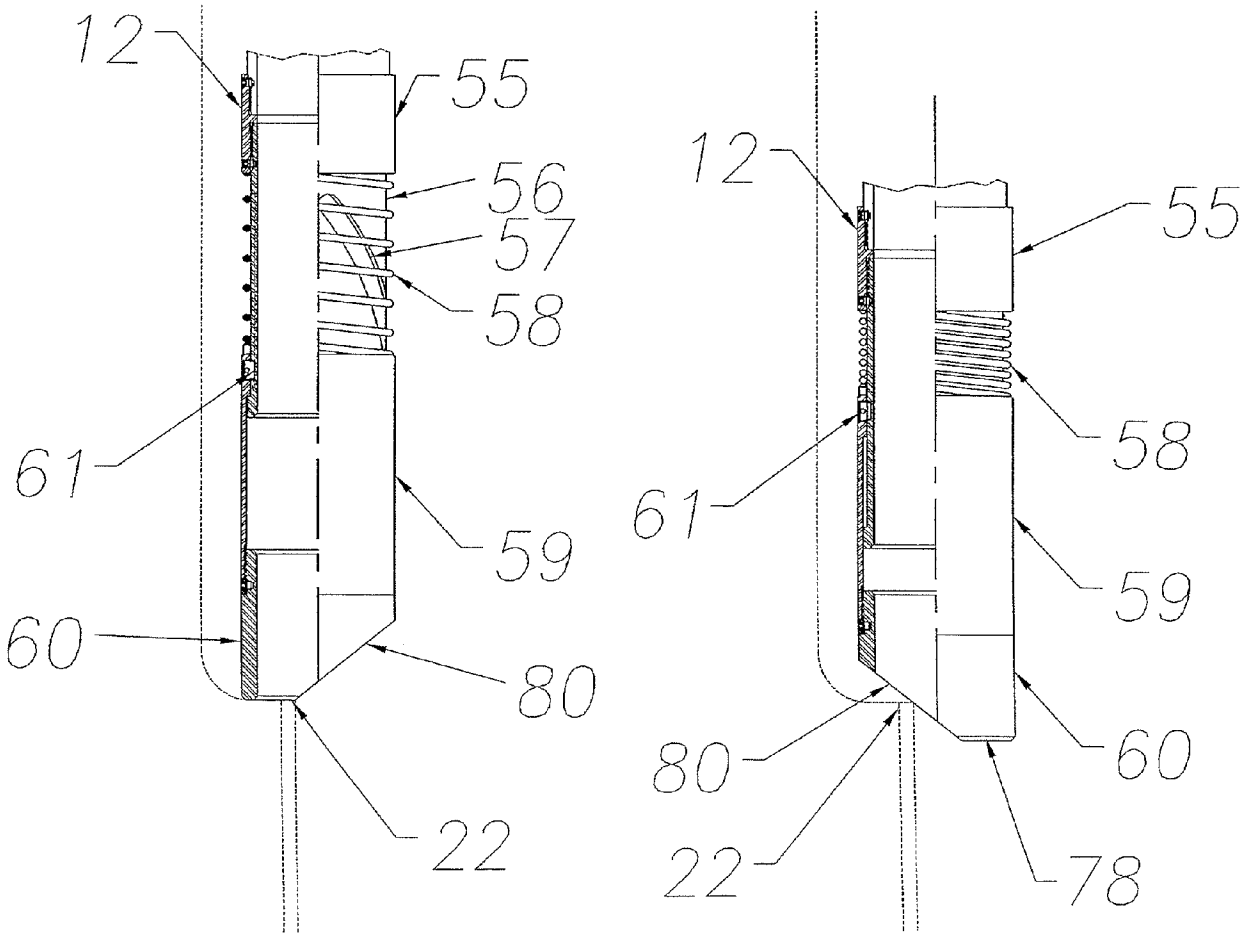
FIG. 4 is a detailed side view showing the rotating mule shoe assembly in both an extended orientation and an original orientation.

On the bottom of the inner string 20, connected to the floating seal mandrel 11, is a rotating mule shoe assembly 12 as shown in FIG. 4. The rotating mule shoe assembly 12 comprises a mule shoe connector 55, a rotator mandrel 56 which includes therein a spiral slot 57 in which slides a guide screw(s) 61 which is affixed to the rotator housing 59 which is positioned outward and concentric with the rotator mandrel 56, a return spring 58 which urges the rotator housing 59 to the lowermost or extended position, and a mule shoe 60 which has an end shaped as a wedge 80. As the inner string 20 is lowered in the multilateral well 104 and the mule shoe end assembly 12 contacts a solid surface such as the edge 22 of the window 24, the rotator housing 59 remains stationary and the rotator mandrel 56 continues moving downward compressing the return spring 58. The guide screw(s) 61 tracks through the spiral slot 57 in the rotator mandrel 56 causing the rotator housing 59 and mule shoe 60 to turn and relocate the wedge 80 in the proper orientation, acting as a guide past the solid surface 22 for the inner string 20 in the proper direction at the proper time. That is, the rotating mule shoe assembly 12 guides the inner string 20 into the lateral well bore 102 when the window 21 of the diverter body 9 is positioned towards the lateral well bore 102, or back to the main well bore 100 when the window 21 is facing blank casing 105. Once past the solid surface, the return spring 58 pushes the mule shoe 60 and rotator housing 59 back to its original position.

As shown in FIG. 2, an indexing alignment assembly 13 lies below the floating polished bore receptacle 10 which is in turn connected to the diverter body 9 and its window 21. As described below, the indexing alignment assembly 13 is adapted for selective engagement with the alignment collar 14. Referring to FIGS. 5*a*, 5*b*, 5*c* and 5*d*, the indexing alignment assembly 13 includes an alignment mandrel 40, a lock ring 41 threadingly engaged to the alignment mandrel 40, an index ring 42 slidingly engaged to the alignment mandrel 40, key(s) 43 engaged with the index ring 42 into a slot 83 in the alignment mandrel 40 which permit axial sliding of the index ring 42 but prevents rotation, and alignment body 44 which is threadingly engaged to the alignment mandrel 40. The key housing 45 includes an upper half 48 and a lower half 49 secured concentric to the alignment body 44 by screw(s) 50 and rotationally by keyway 51. The top half of the key housing 48 contains an aperture 84 through which the locating key 46 protrudes outwardly and is urged outwardly by a plurality of locating key spring(s) 47, and the outward travel of the locating key 46 is limited by the shoulder 52 on the locating key 46 and a shoulder 85 in the aperture 84 in the key housing 53.

Figure 5A:
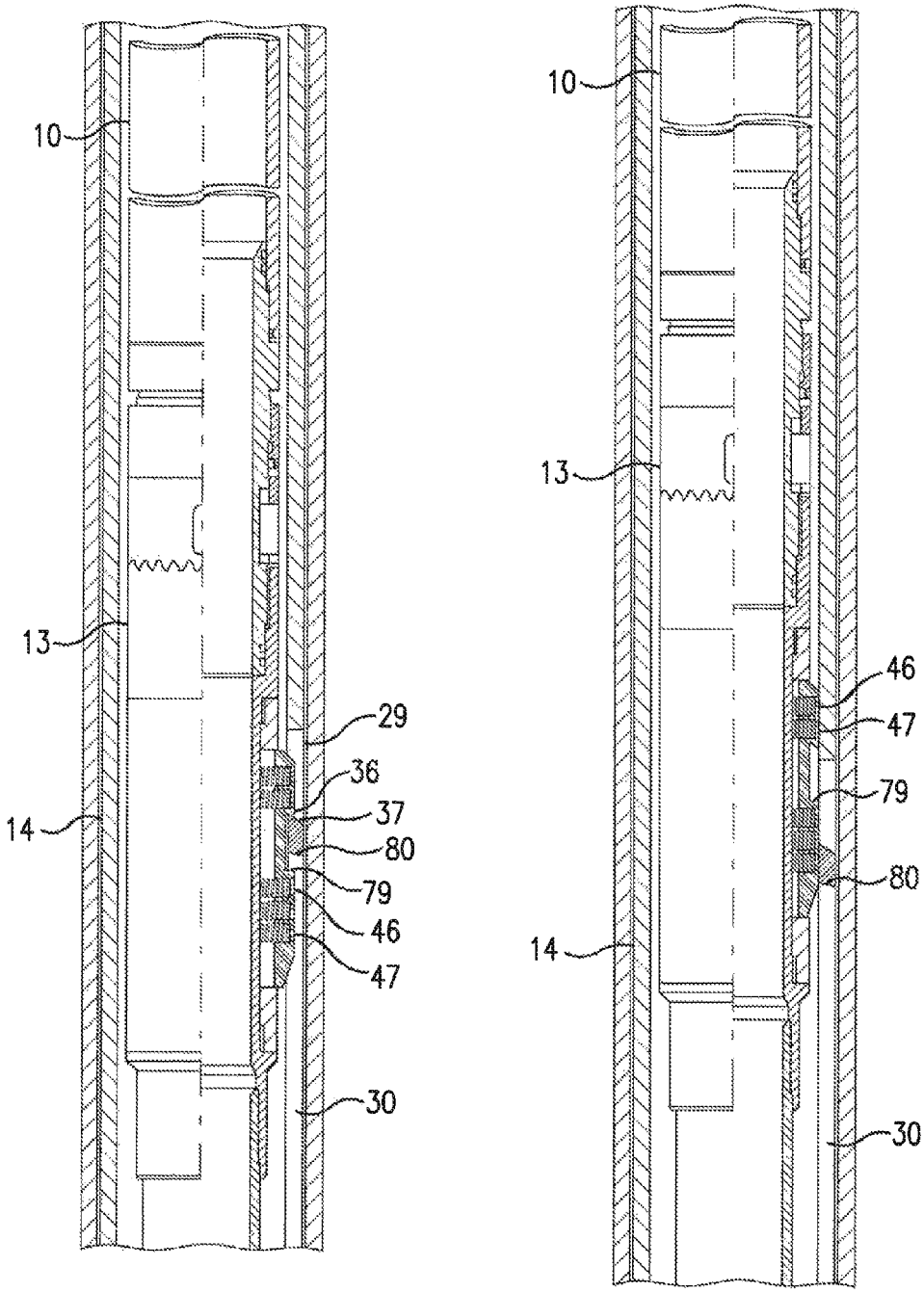
FIGS. 5*a*, 5*b*, 5*c* and 5*d* provide various cross sectional views of the indexing alignment assembly.
Figure 5C:
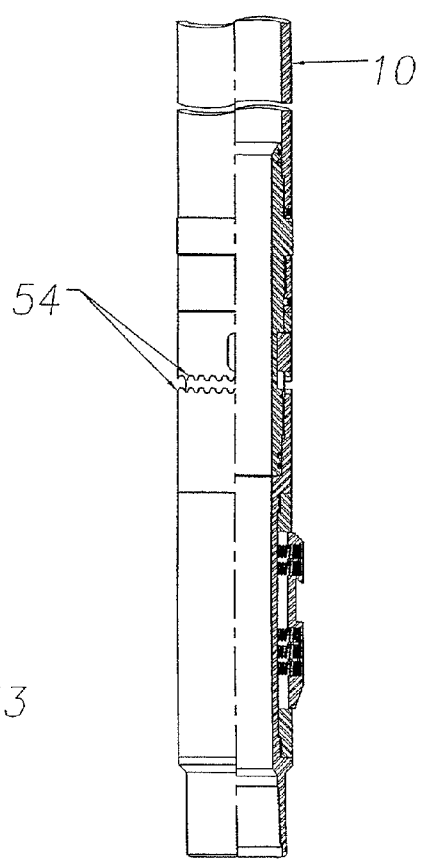
Figure 5D:
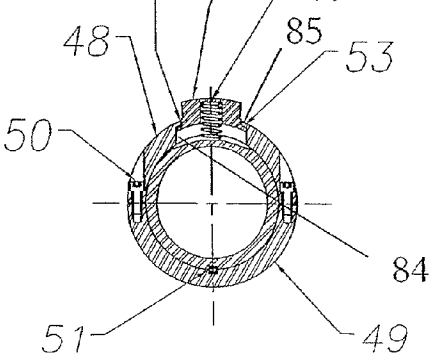
Figure 5B:
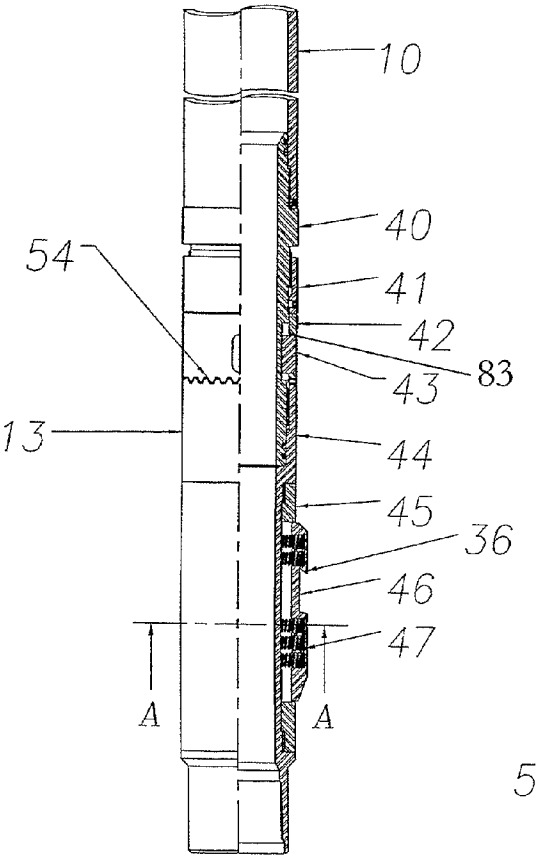

More particularly, the indexing alignment assembly 13 functions to maintain rotational alignment of the window 21 in the diverter body 9 with the locating key 46. This ensures the window 21 of the diverter body 9 faces the same direction relative to the indexing alignment assembly 13 as the whipstock that was used to create the original lateral well bore 102. The index ring 42 and the alignment body 44 each have a series of mating alignment teeth 54 on the ends thereof (see FIGS. 5*b* and 5*c*). When the respective teeth are engaged (as shown in FIG. 5*b*), the index ring 42 prevents the alignment body 44 from rotation relative to the alignment mandrel 40.

In preparation for a job, the alignment body 44, along with the locating key 46, is rotated relative to the alignment mandrel 40 to position the window 21 of the diverter body 9 to face the desired direction. The index ring 42 slides axially on the alignment mandrel 40 to engage the mating alignment teeth 54. The lock ring 41 is threaded down against the index ring 42 which forces the respective teeth of the index ring 42 and alignment body 44 to maintain engagement and alignment. Thus, when the multilateral access assembly 77 is conveyed in the well bore 100 and the locating key 46 is positioned in the alignment collar 14, the window 21 in the diverter body 9 will face the lateral well bore 102 as planned.

The locating key springs 47 maintain an outward force on the locating key 46 while the workstring 1 traverses up and down in the well 104. The locating key 46 latches into the alignment collar 14 which is positioned in the casing string 105 when the main well bore 100 is created. It should be appreciated the alignment collar 14 is used to position, orient and anchor the whipstock previously used for drilling the lateral well bore 102. The multilateral access assembly 77 uses the same alignment collar 14 along with the locating key 46 to position and orient the window 21 of the diverter body 9 toward the lateral well bore 102.

It is appreciated that the alignment collar and locating key arrangement described herein are conventional in the industry, and variations known in the industry may be employed. In accordance with a preferred embodiment as described with reference to FIG. 1*a*, the alignment collar 14 has a curved guide 30 and a shaped keyhole 29 into which the locating key 46 secures. As shown in FIG. 5*a*, the keyhole 29 is configured such that the locating key 46 will only engage and latch in place when the locating key 46 is moving upward in the well, and will not engage when travelling downward in the well unless the locating key 46 and the keyhole 29 are in exact alignment.

In accordance with a preferred embodiment, a length of spacer pipe 15 is positioned below the indexing alignment assembly 13. The length of the spacer pipe 15 is chosen based on the well parameters as will be determined by those skilled in the art. Below the spacer pipe 15 are the lower extension mandrel 39 and the lower seal assembly 17. The lower seal assembly 17 engages with the lower polished bore receptacle 19 located in the main well bore 100 of the multilateral well 104. The lower seal assembly 17 preferably includes at its distal end a rotating mule shoe assembly 18 so that the workstring 1 will automatically guide the lower seal assembly 17 into the lower polished bore receptacle 19 without requiring manipulation of the workstring 1 from the surface.

Running the Multilateral System

Figures 1, 6:
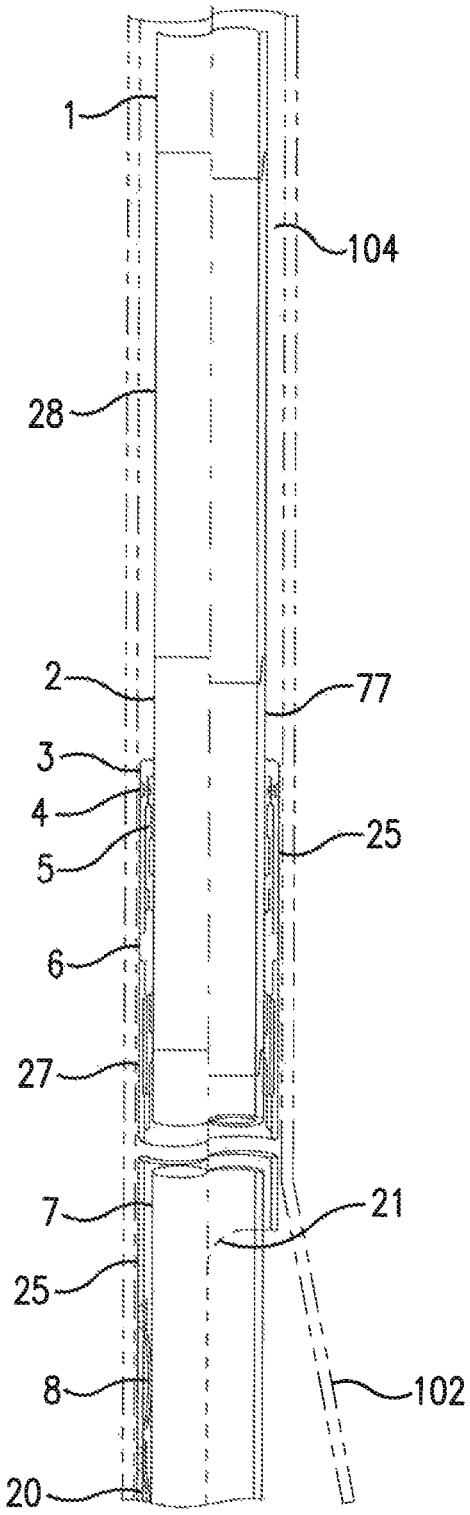
FIGS. 6, 8, 9, 10, 11, and 12, which are all composed of multiple figures designated respectively as FIGS. 6-1 through 6-3, FIGS. 8-1 through 8-2, FIGS. 9-1 through 9-2, FIGS. 10-1 through 10-2, FIGS. 11-1 through 11-2, and FIGS. 12-1 through 12-2, show various steps in the operation of the present multilateral access assembly.
Figures 2, 6:
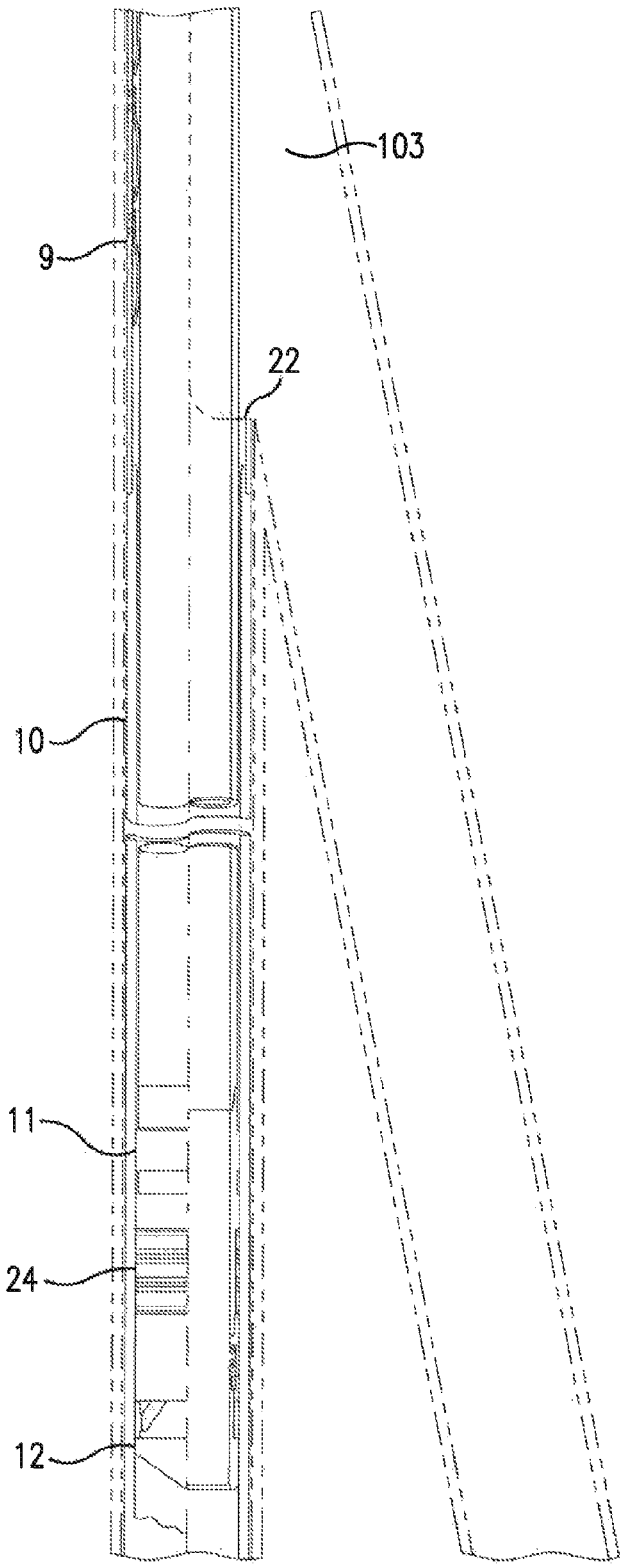
Figures 3, 6:
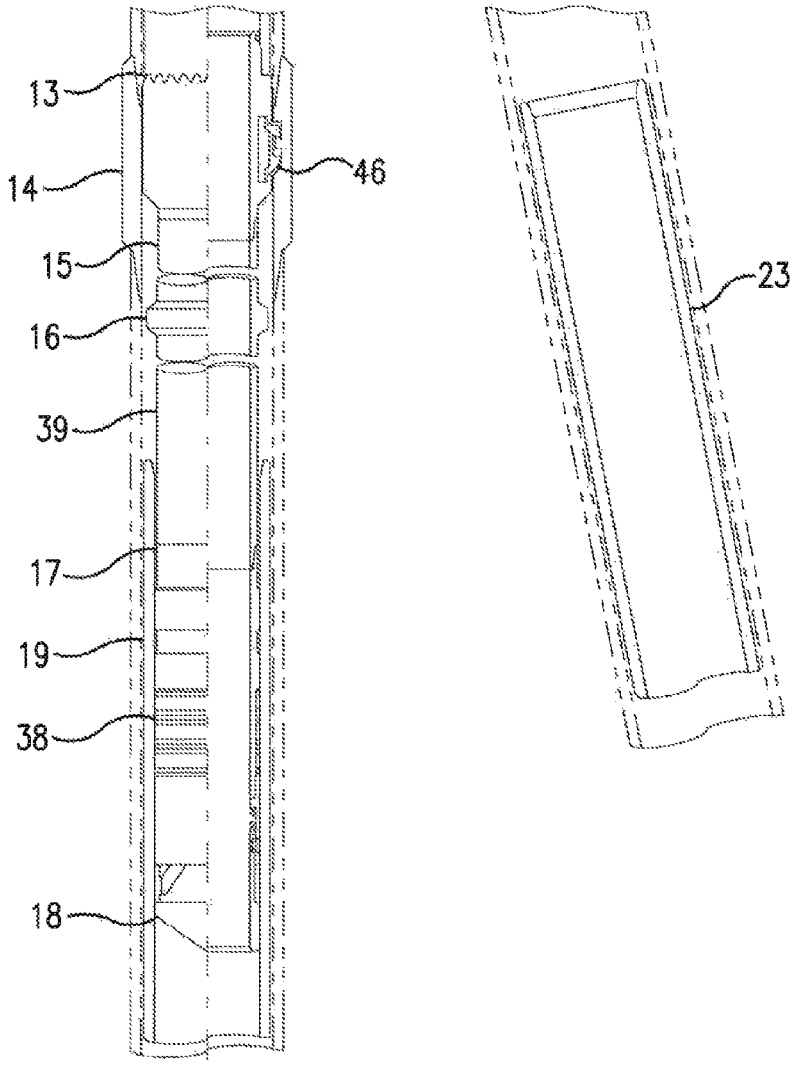

Job preparation includes determining the length of floating polished bore receptacle 10 that is required for pressure and temperature compensation, the spacing of the alignment collar 14 to the top of the lower polished bore receptacle 19, and the spacing of the alignment collar 14 to the window 103 of the lateral well bore 102. The appropriate spacer pipe(s) 15 is selected to achieve axial alignment once the diverter body 9 is positioned in the multilateral well 104 such that the window 21 in the diverter body 9 is in the proper axial and rotational alignment with the window 103 cut in the main bore 100 to permit free passage of the workstring 1 at the appropriate time and that the lower seal assembly 17 maintains sealing engagement with the lower polished bore receptacle 19, as shown in FIG. 6. Finally, the locating key 46 is rotationally positioned as described above so that the window 21 of the diverter body 9 faces the aperture, or window, 103 of the lateral well bore 102 when the locating key 46 is secured in place in the alignment collar 14.

The multilateral access assembly 77 is conveyed into the well bore 100 on the workstring 1 as shown in FIG. 2. As the lowermost end, that is the bottom of the rotating mule shoe assembly 18, of the system approaches the top end of the lower polished bore receptacle 19, the operator may choose to pump fluids through the workstring 1 while lowering the workstring 1. As the lowermost end of the rotating mule shoe assembly 18 enters the lower polished bore receptacle 19, the reduced clearance between the outside of the mule shoe 18 and the inside of the polished bore receptacle 19 will cause the pump pressure to increase, which gives an indication at surface of the position of the system in the well bore 100. Normally, at that point, the pump flow and applied pressure is ceased to permit the unimpeded entry of the lower seal assembly 17 into the lower polished bore receptacle 19. The workstring 1 is lowered into the well bore 100 until the stop collar 16 shoulders on the lower polished bore receptacle 19 and the lower seal assembly 17 is fully engaged into the lower polished bore receptacle 19.

At this point, in accordance with commonly employed practices, the workstring 1 length is adjusted in such a way that the upper end of the workstring 1 is conveniently accessible at the surface for subsequent operations. This procedure, referred to in the industry as "spacing out," uses the aforementioned spacings determined as part of the job preparation, and the lengths of the workstring joints at surface when the multilateral access system shoulders out to determine the length of a spacer joint(s), or "pup" joint(s), such that when the workstring is secured at surface, the multilateral access assembly 77 is engaged in the alignment collar 14 and the lower seal assembly 17 is engaged to the lower polished bore receptacle 19 thus providing complete full bore and pressure integrity throughout the well 104 (See FIG. 2).

Then, the entire multilateral assembly is picked up and is moved upwardly in the main well bore 100 as shown in FIG. 6. As the locating key 46 enters the alignment collar 14 in the casing string 105, the curved guide 30 causes the locating key 46 and the entire multilateral access assembly 77 and workstring 1 to rotate until the locating key 46 is aligned with the keyhole 29 in the alignment collar 14. The multilateral access assembly 77 moves upward until the locating key 46, urged outwardly by the locating key springs 47, snaps into place as shown in FIG. 5*a*. The locating key 46 has a back angle "hook" 36 which mates with a similarly angled surface 37 on the alignment collar 14 to prevent the multilateral access assembly 77 from being able to move back down the well. As a result, setting weight back down confirms that the locating key 46 is properly located as shown in FIG. 6.

The workstring 1 is lowered into the well bore 100 further until the weight of the workstring 1 shears the release shear screws 4 in the upper end of the multilateral access assembly 77 (see FIG. 3*b*). When the release shear screws 4 are sheared, the running collet 5 is free to travel downward with the anchor mandrel 2. The mating hooked threads or teeth 67 of the collet and the threads or teeth 82 of the support collar 3 are engaged as in FIGS. 3*a* and 3*b*, which stops the travel of the running collet 5 and releases the support of the mating teeth 81, 64 on the anchor mandrel 2 and the running collet 69, after which the inner string 20 and the outer string 25 are disengaged from each other. At this point, the inner string 20 is repositioned so that the floating seal mandrel 11 is located in the lowermost end of the floating polished bore receptacle 10, and the lower seal assembly 17 is positioned in the lower polished bore receptacle 19 in the main well bore 100. Thus, the multilateral access assembly 77 provides full bore pressure contained access from the surface to the main well bore 100 so that stimulation and intervention services may be carried out.

Repositioning the Multilateral System to Access the Lateral Well Bore

Figure 7A:
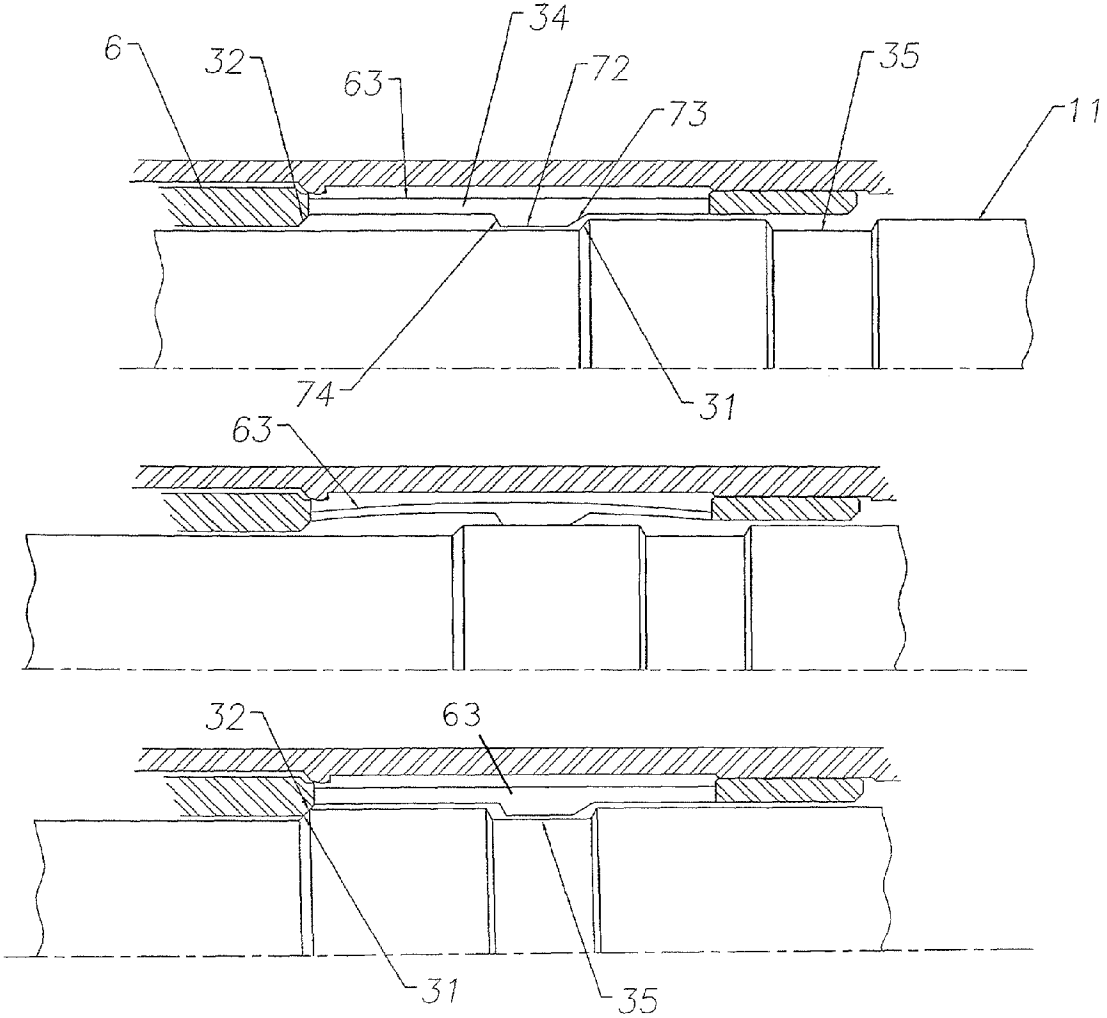
FIG. 7*a* and 7*b* show the various interaction steps between the floating seal mandrel and the snap latch sub.
Figures 1, 8:
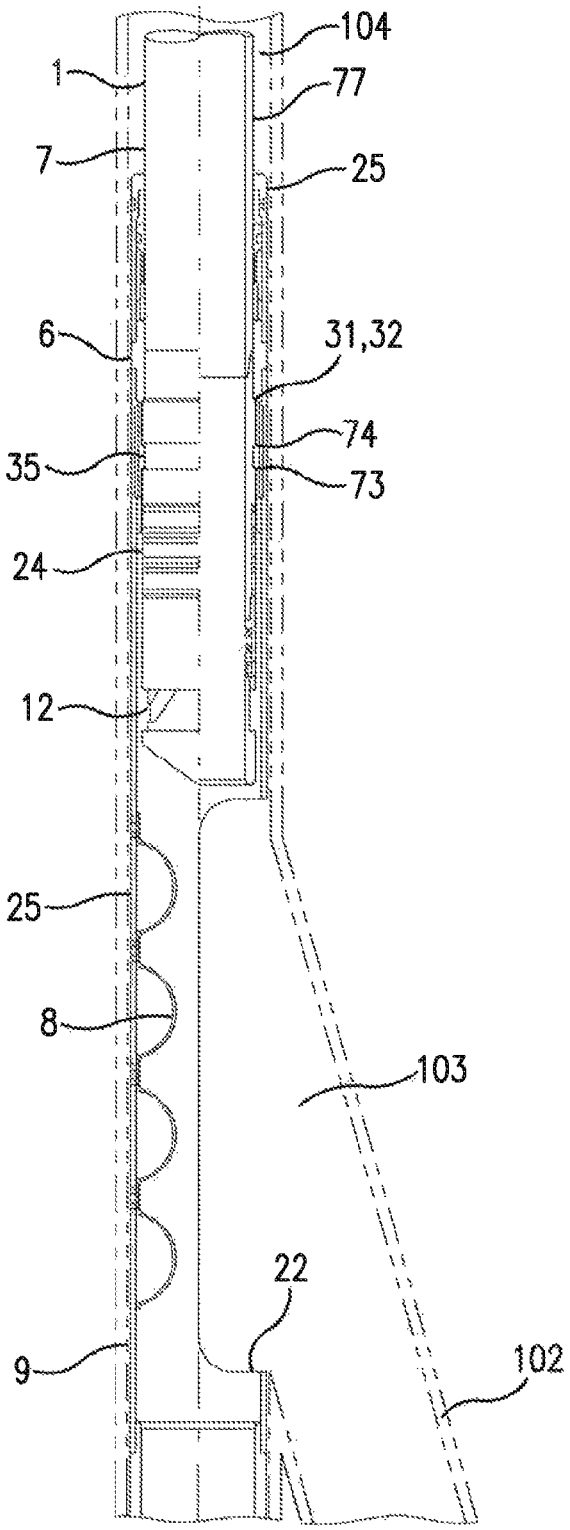
Figures 2, 8:
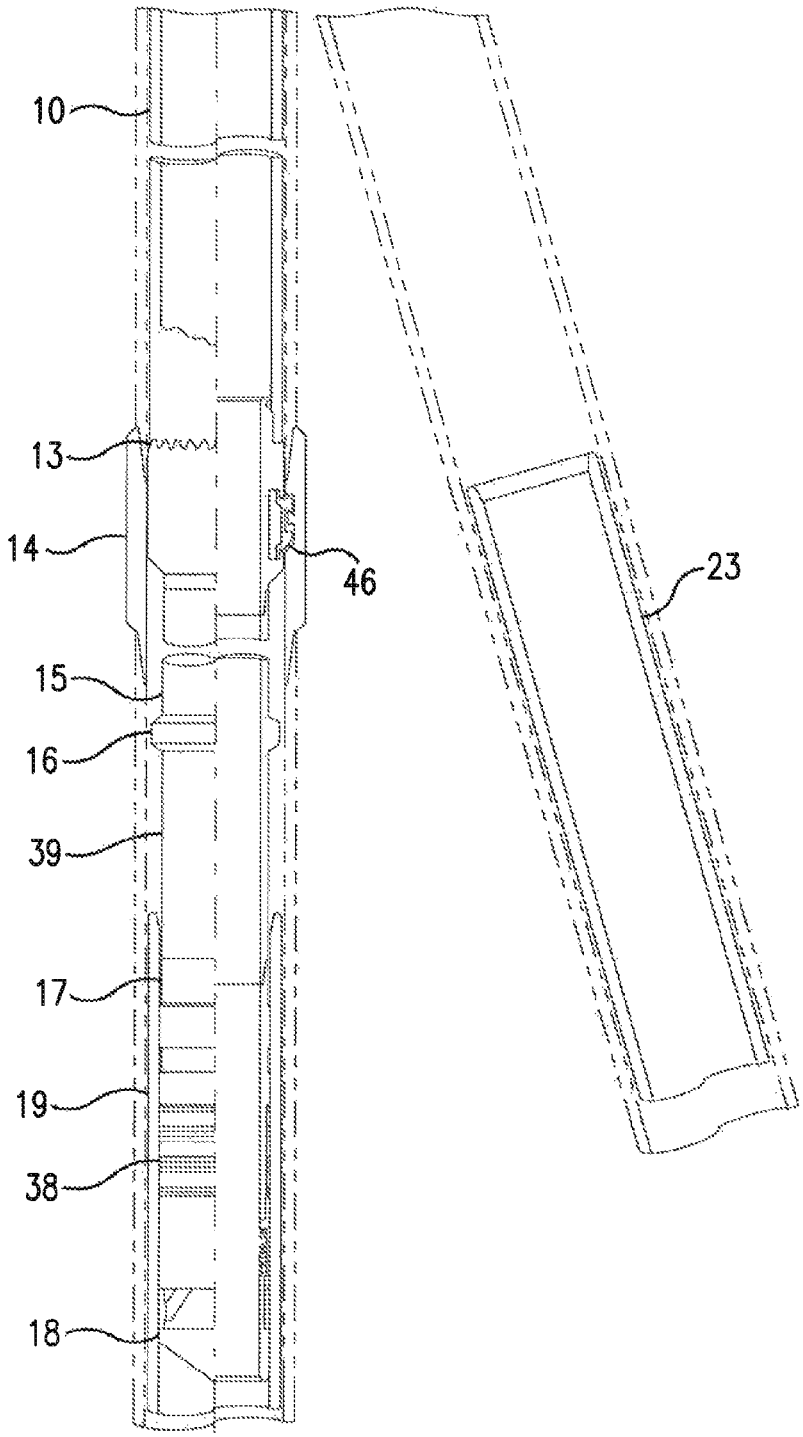
Figures 1, 9:
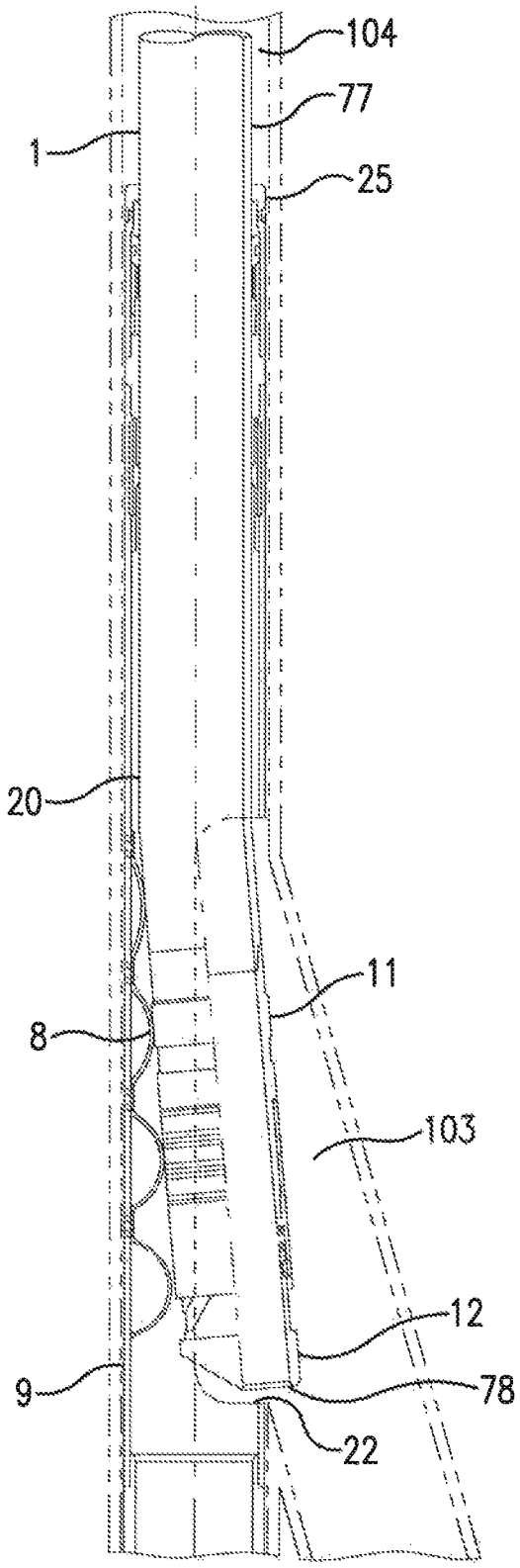
Figures 2, 9:
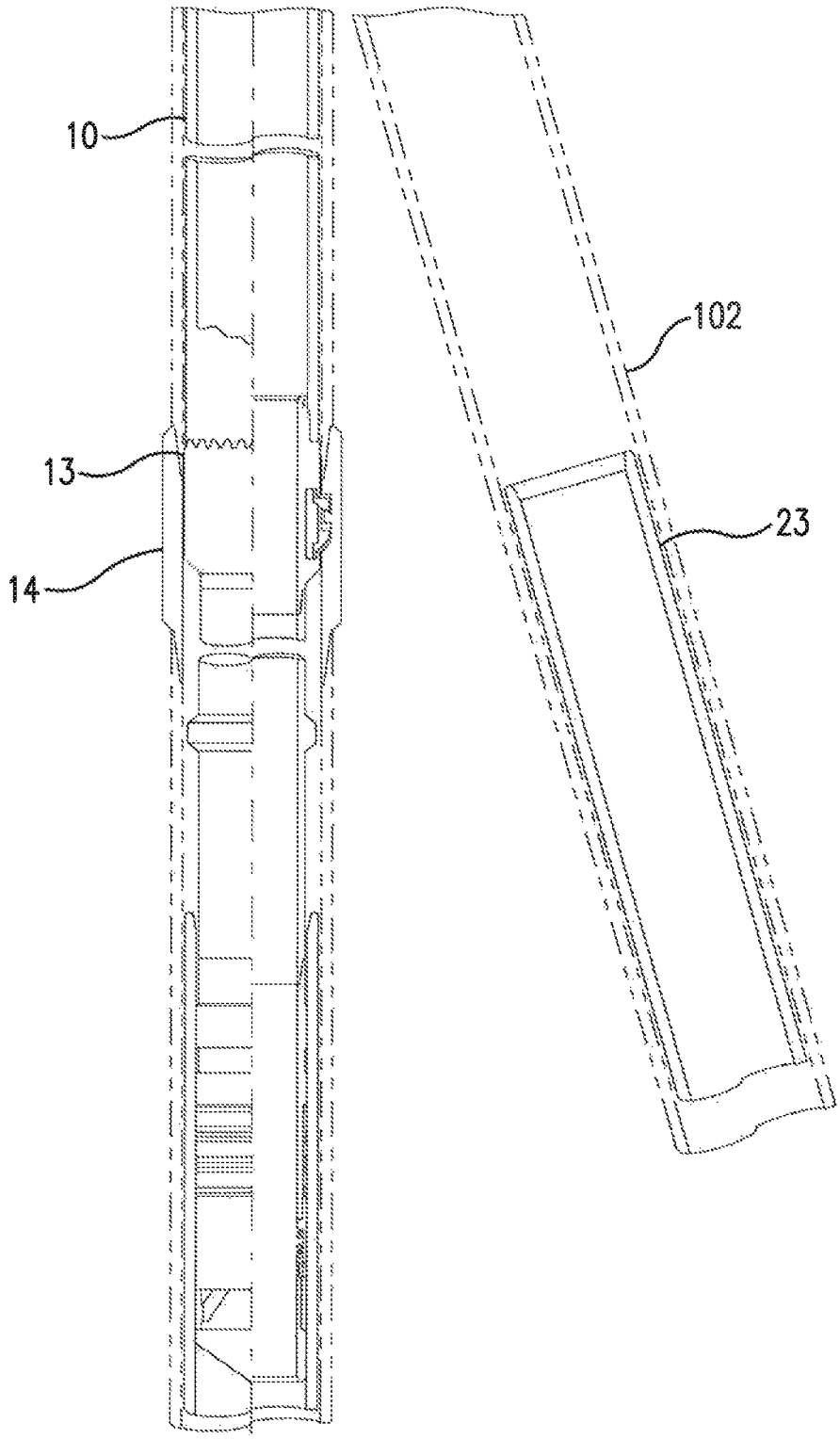
Figures 1, 10:
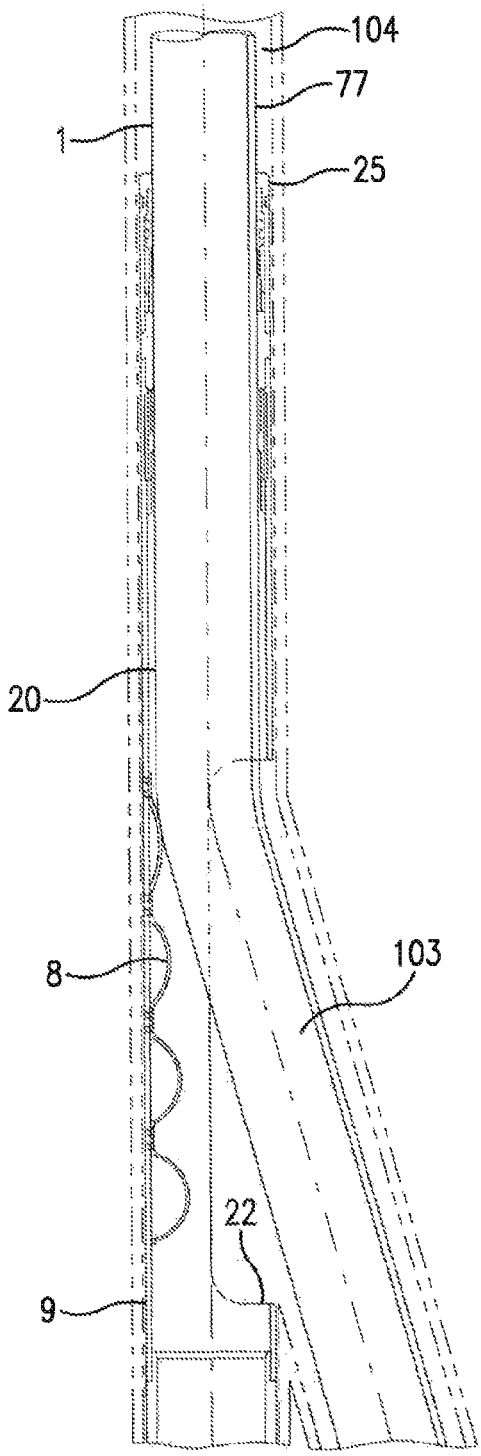
Figures 2, 10:
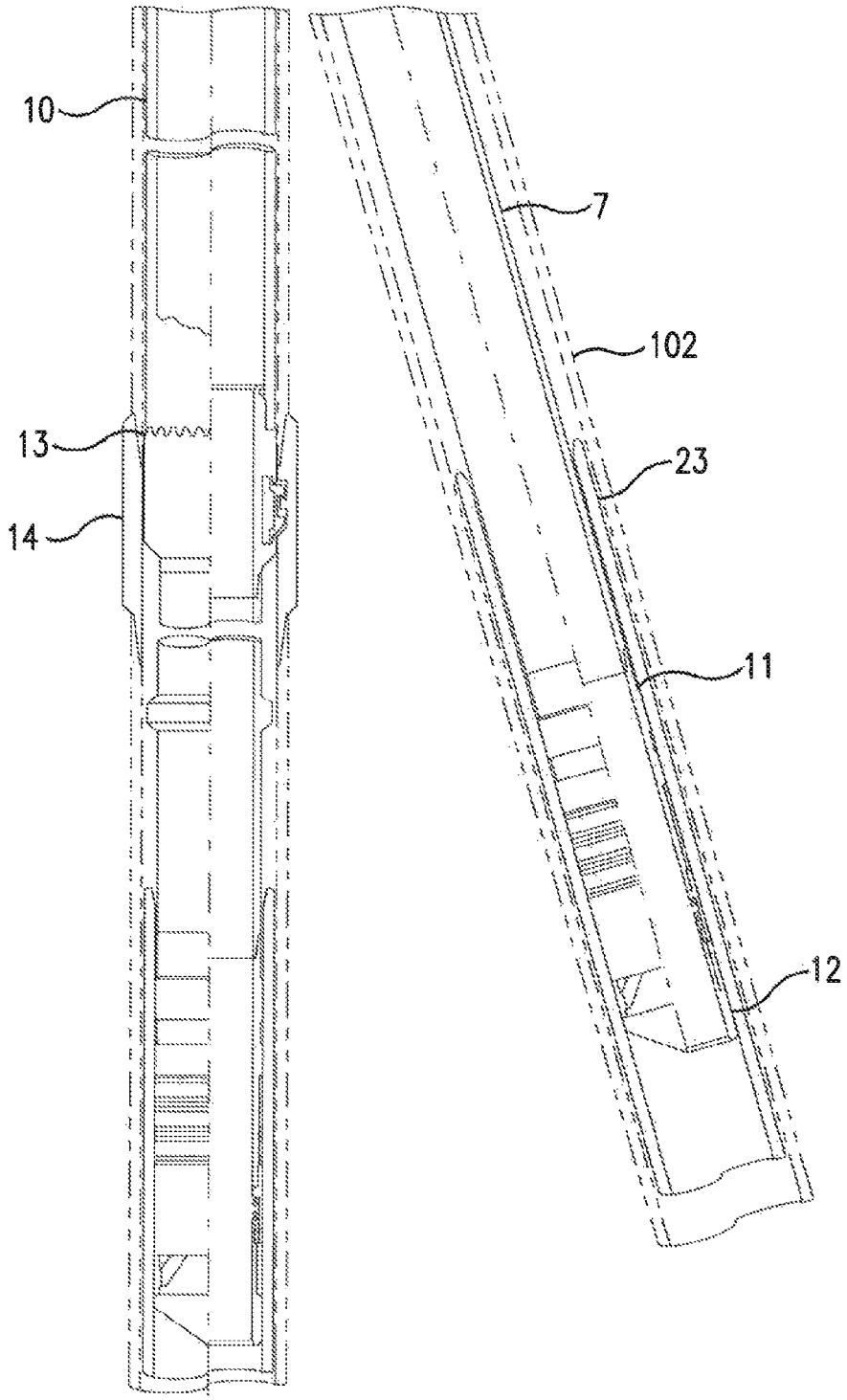

To reposition the multilateral access assembly 77 to access the lateral well bore 102 with the workstring 1, the inner string 20 is moved upward in the main well bore 100 all the way until the shoulder 31 on the floating seal mandrel 11 stops against the internal shoulder 32 of the snap latch sub 6 as shown in FIGS. 7*a* and 8. The workstring 1, including aforementioned components such as the upper rotating mule shoe assembly 12, is subsequently lowered back though the diverter body 9. The diverter springs 8 exert a lateral force on the lower end of the inner string 20 urging the end of the inner string 20 toward the milled casing window 103 as shown in FIG. 9. If the end of the inner string 20 contacts the diverter window edge 22 with the flat end 78 of the rotating mule shoe assembly 12, the flat end 78 of the rotating mule shoe assembly 12 will rotate into the correct position as the inner string 20 is lowered further (see FIG. 10, guiding the end of the inner string 20 out into the lateral well bore 102. The inner string 20 is lowered further until the floating seal mandrel 11 engages with the lateral polished bore receptacle 23 as shown in FIG. 10. The multilateral access assembly 77 now provides full bore pressure contained access from the surface to the lateral well bore 102 so that stimulation and intervention services may be carried out.

Repositioning the Multilateral System to Additional Lateral Well Bores

To reposition the multilateral access assembly 77 to access additional upper lateral well bores 102 with the workstring 1, the inner string 20 is moved upward in the main well bore 100 all the way until the shoulder 31 on the floating seal mandrel 11 stops against the internal shoulder 32 of the snap latch sub 6 as shown in FIG. 8. Tension on the workstring 1 is applied from surface against the workstring 1 until the angled face 79 on the locating key 46 wedges past the angled face of the alignment collar 14, compressing the locating key springs 47 under the locating key 46 until the locating key 46 snaps free of the alignment collar 14 as show in FIG. 5*a*.

As shown with reference to FIG. 7*a*, the rotational lock in the form of detent fingers 63 of the snap latch sub 6 is comprised of internal protrusions 72 with a specific face angle 73 and specific back angle 74 which is slotted a certain length 34 to act as spring loaded detent fingers 63. As the floating seal mandrel 11 moves upward, the face angle 73 of the internal protrusions 72 of the detent fingers 63 have a shallow angle which reduces the deflection force of the detent fingers 63 and allows the floating seal mandrel 11 to snap into place via a recessed groove 35 on the floating seal mandrel 11 with a low force. As the floating seal mandrel 11 moves downward, the back angle 74 of the detent fingers 63 have a steep angle which increases the deflection force of the detent fingers 63 and allows the floating seal mandrel 11 to snap out of the recessed groove 35 on the floating seal mandrel 11 with a high force. The steep angle 74 provides a large snap-out force to overcome drag forces of the outer string 25 inside the main bore 100, allowing the multilateral access assembly 77 to be pushed back down the well without the inner string 20 moving towards the diverter body 9 until desired.

Figures 1, 11:
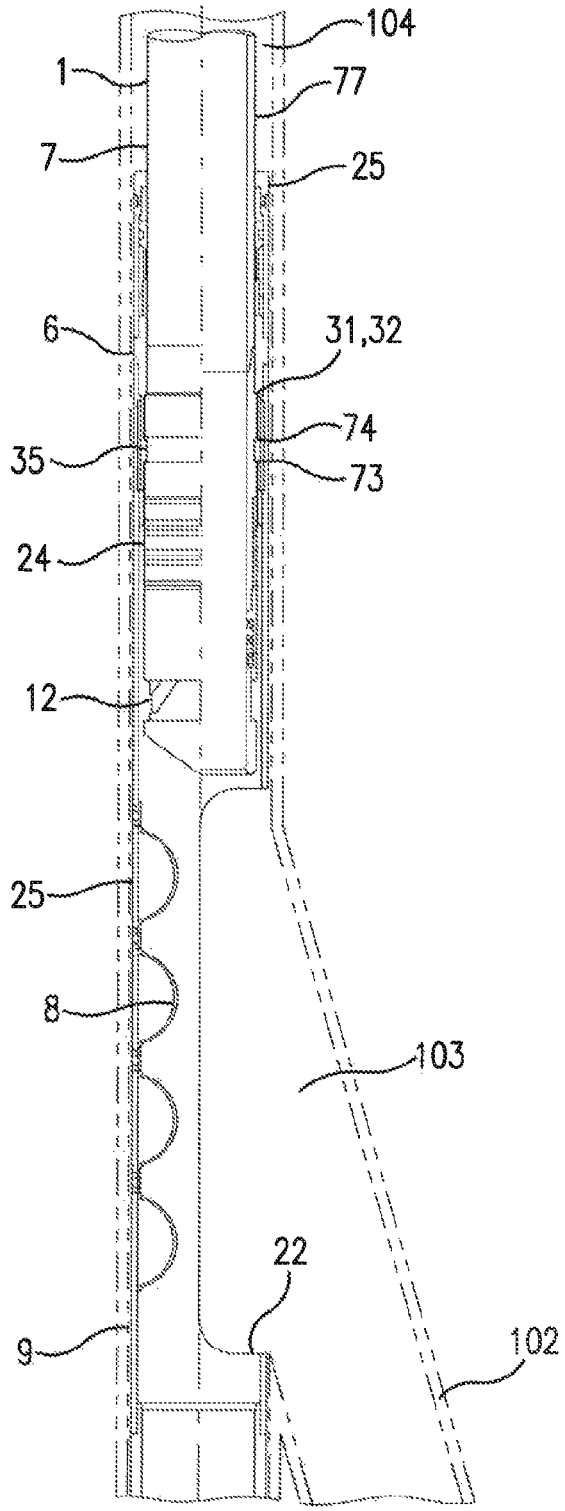
Figures 2, 11:
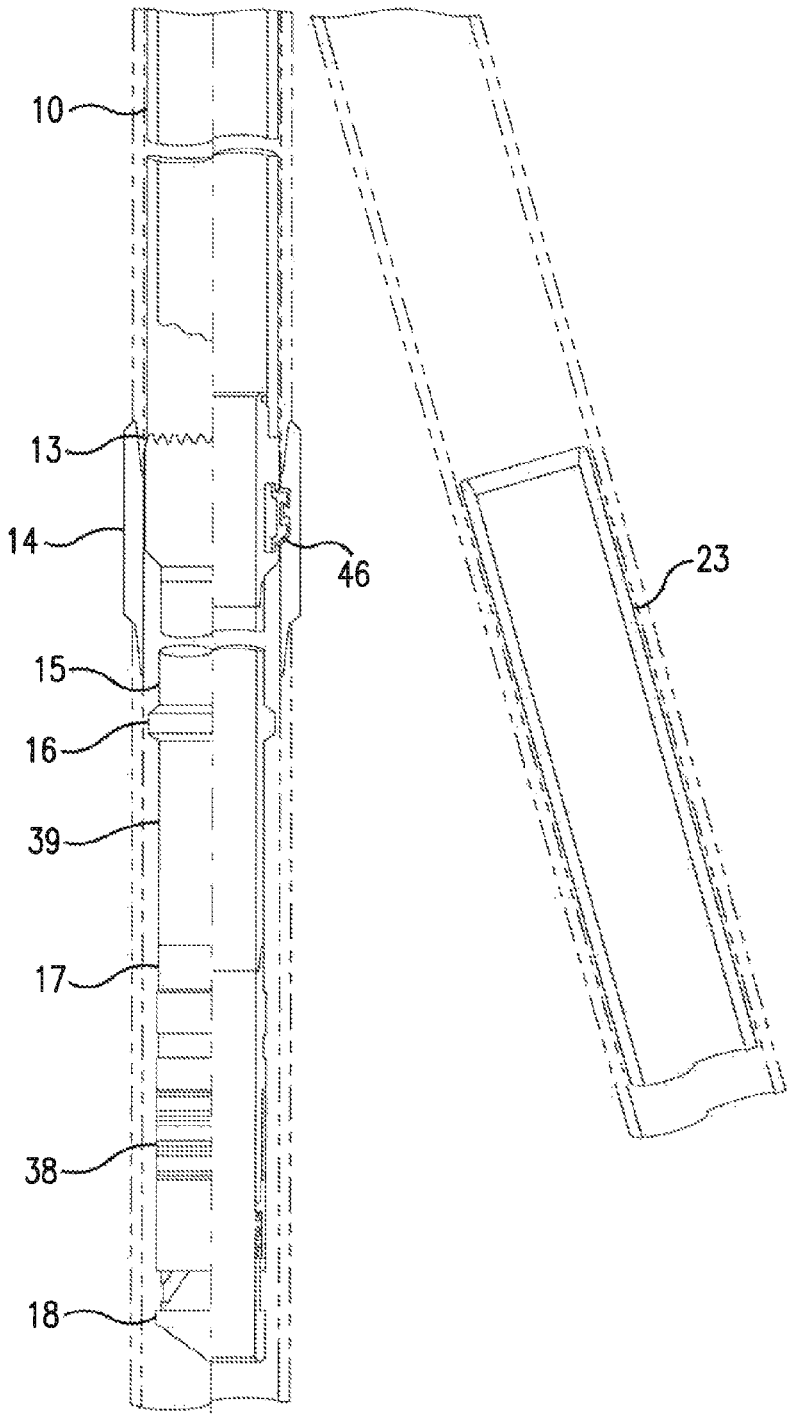

At this point, the entire multilateral assembly 77 is picked up and is moved upwardly in the main well bore 100 as shown in FIG. 11. The locating key 46 enters the next alignment collar 14 in the casing string and the curved guide 30 causes the locating key 46 and the entire outer string 25 to rotate until the locating key 46 is aligned with the keyholes 29 in the alignment collar 14. The multilateral access assembly 77 moves upward until the locating key 46, urged outwardly by the locating key springs 47, and snaps into place, as before. The workstring 1 is lowered in the well in order to move the floating seal mandrel 11 towards the lateral well bore 102. The downward movement of the floating seal mandrel 11 causes the detent fingers 63 to deflect outwardly as the internal protrusion 72 wedges against the steep angle 74 of the detent fingers 63 (see FIGS. 7*a* and 7*b*). Once the floating seal mandrel 11 snaps out of the detent fingers 63 the inner string 20 may be lowered to position the floating seal mandrel 11 into the next lateral bore.

The methods to enter the upper lateral to perform intervention services are essentially the same as the first lateral. This repositioning process may be repeated to access additional lateral well bores 102 further up the multilateral well 104. At each upper lateral position, "space out" procedures must be performed as per common practice.

Repositioning the Multilateral System to Re-Access the Main Bore

To regain access to the main well bore 100, the inner string 20 is moved upward in the main well bore 100 all the way until the shoulder 31 on the floating seal mandrel 11 stops against the internal shoulder 32 of the snap latch sub 6 as shown in FIG. 8. Tension on the workstring 1 is applied from surface against the outer string 25 until the angled face 79 on the locating key 46 wedges past the angled face 80 of the alignment collar 14, compressing the locating key springs 47 under the locating key 46 until the locating key 46 snaps free of the alignment collar 14.

Figure 7B:
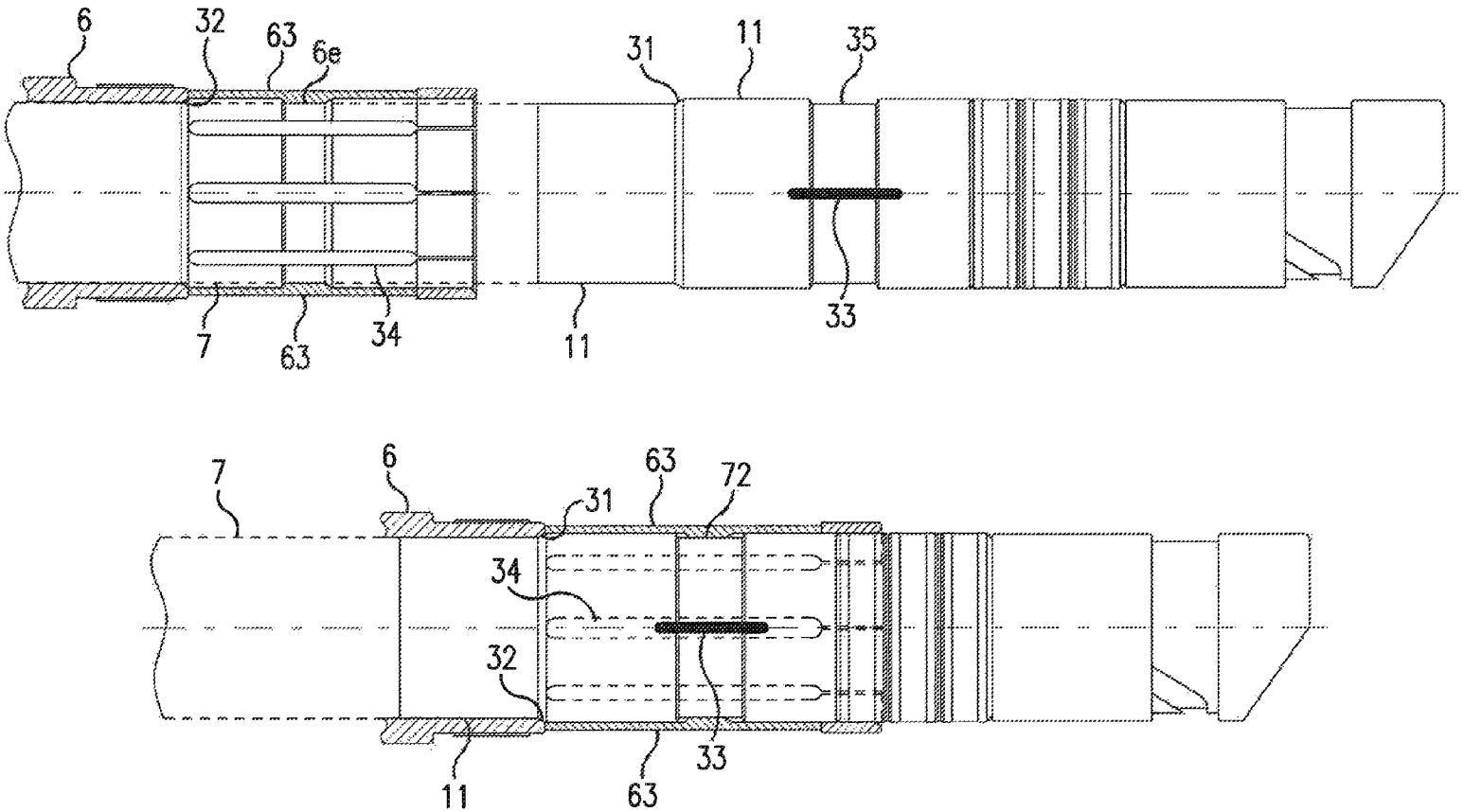

It may be necessary or desirable to manually rotate the outer string 25 so that the locating key 46 does not inadvertently re-engage the keyholes 29 in the alignment collar 14 or to catch in a milled casing window 103 as the workstring 1 is lowered to reengage the main bore 100. Referring to FIG. 7*b*, the floating seal mandrel 11 has a key 33 located longitudinally in the recessed groove 35 into which the detent fingers 63 snap. The key 33, when properly aligned, locates and resides in the longitudinal slots 34 between the detent fingers 63 when the detent fingers 63 snap into the groove 35. As the workstring 1 is rotated at surface, the key 33 bears on the side of the internal protrusion 72 of the detent finger 63, thus transmitting rotational torque to the outer string 25 so that the locating key 46 may be rotationally repositioned away from the keyholes 29 in the alignment collar 14, or away from the milled casing window 103 as needed. This ability, being unique, ensures that the entire multilateral access assembly 77 may be lowered to reengage the main well bore 100 without interference between the locating key 46 and the key slot(s) 29 or the milled casing opening(s) 103.

Figures 1, 12:
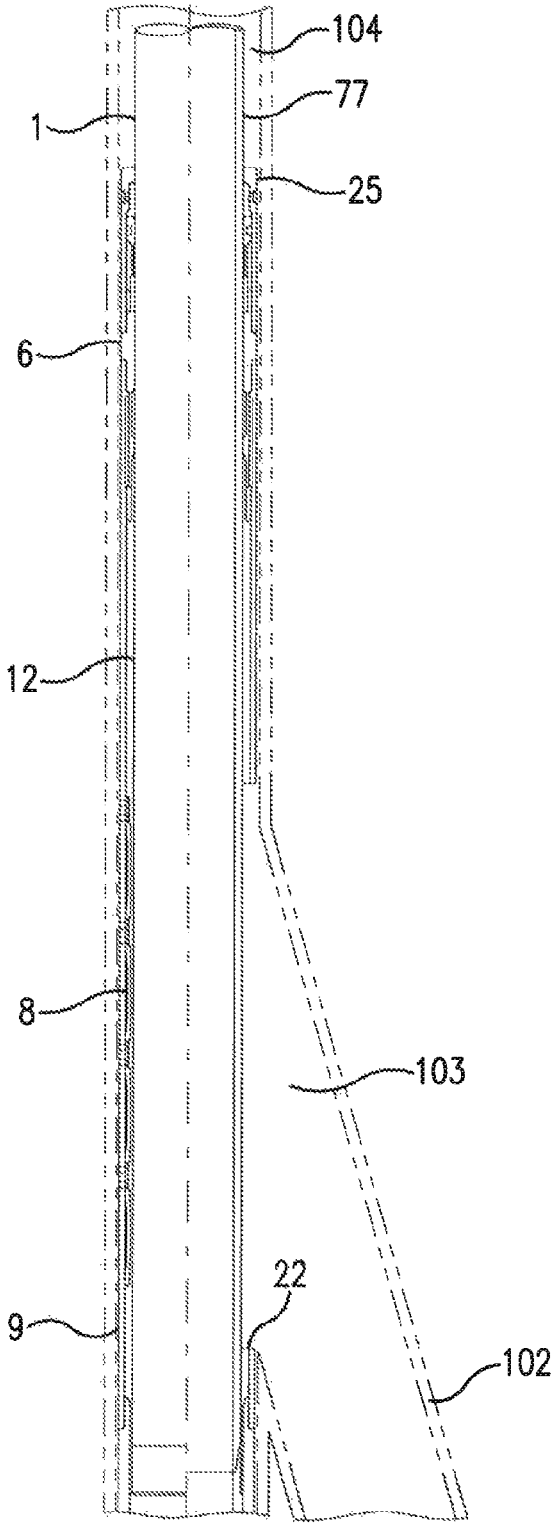
Figures 2, 12:
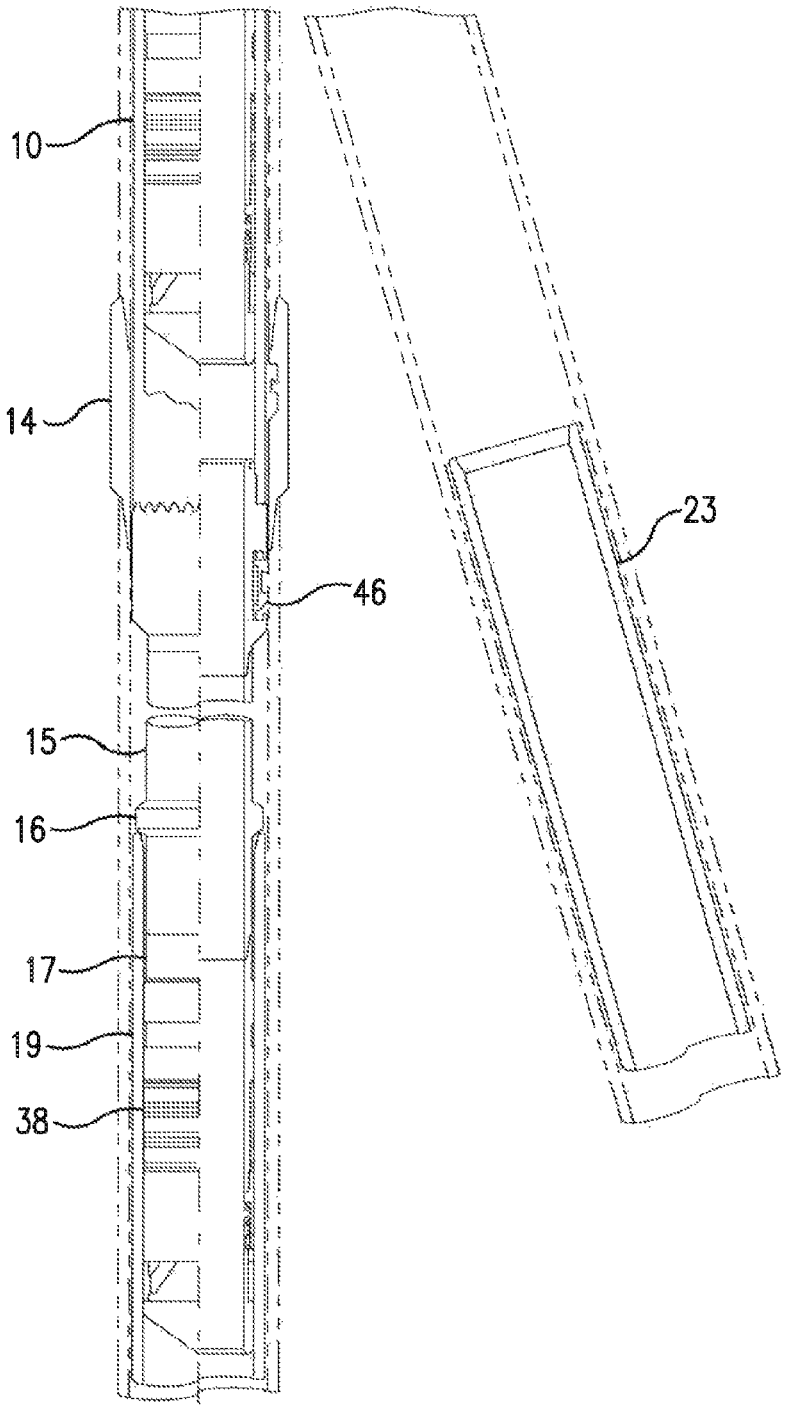

The multilateral access assembly 77 is lowered back down the main bore 100 so that the lower seal assembly 17 is engaged with the lower polished bore receptacle 19 until the stop collar 16 shoulders on the lower polished bore receptacle as shown in FIG. 12. The detent fingers 63 keep the floating seal mandrel 11 positioned in the snap latch sub 6 until the lower seal assembly 17 is positioned in the lower polished bore receptacle 19, and the stop collar 16 contacts the top of the lower polished bore receptacle 19. Continued lowering of the workstring 1 will apply weight to the detent fingers 63 until the floating seal mandrel 11 snaps free. As the floating seal mandrel 11 passes the window 21 of the diverter body 9, the diverter springs 8 continue to urge the floating seal mandrel 11 towards the window 21 as before. However, the window 21 is now positioned in blank casing 105 (that is, without an aperture cut therein that leads to a lateral bore), so the floating seal mandrel 11 continues to move down along the axis of the diverter body 9 until the floating seal mandrel 11 enters the floating polished bore receptacle 10. The rotating mule shoe assembly 12 ensures that the floating seal mandrel 11 makes the transition from the window 21 back to the bore of the floating polished bore receptacle 10. Once the floating seal mandrel 11 engages the floating polished bore receptacle 10, access to the main well bore 100 is complete.

This process of relocating the multilateral access assembly 77 to the main well bore 100 or lateral well bore(s) 102 may be repeated giving the user access to any well bore on demand without removing the workstring 1 from the well, which is unique in the industry.

The multilateral access assembly configurations required for the various well profiles encountered in the world are not described herein for brevity but should not affect the spirit of the disclosure which describes a method and system which provides access to a main 100 and multiple lateral well bores 102 on demand without tripping/removing the workstring 1 from the well bore. Those skilled in the art will recognize that the multilateral system described here contains the necessary elements to enable full bore pressure contained access to multiple well bores and that minor variations in workstring 1 configurations, such as using a packer instead of a seal assembly are possible.

The invention claimed is:

1. A multilateral access system for a multilateral well including a main well bore and at least one lateral well bate, comprising:

a tubular workstring including an inner string and an outer string;

the outer string includes a diverter body having a cylindrical housing with a lateral window, the diverter body being shaped and dimensioned to direct the inner string through the lateral window and into the at least one lateral well bore wherein the outer string includes, in order from a top of outer string to a bottom of the outer string, a support collar, a running collet, a releasing shear screw, a snap latch sub, an extension housing and the diverter body, a floater polished bore receptacle, an indexing alignment assembly with a locating key, a spacer pipe, a stop collar, a lower exstension mandrel, a lower seal assembly with a sealing stack, and a rotating mule shoe assembly and wherein the indexing alignment assembly ensures the window of the diverter body faces the same direction relative to the indexing alignment assembly as a whipstock used to create an original lateral well bore and wherein the indexing alignment assembly includes an alignment mandrel, a lock ring threadingly engaged to the alignment mandrel.

2. The multilateral access system according to claim 1, wherein the diverter body includes a spring device biasing the inner string toward the lateral window of the diverter body.

3. The multilateral access system according to claim 2, wherein the spring device is composed of a series of leaf springs which, as the inner string passes therethrough, function to urge the inner string outward towards and through the lateral window and into the at least one lateral well bore.

4. The multilateral access system according to claim 1, wherein the indexing alignment assembly also includes an index ring slidingly engaged to the alignment mandrel, and a key engaged with the index ring into a slot in the alignment mandrel which permits axial sliding of the index ring but prevents rotation.

5. The multilateral access system according claim 4, wherein the indexing alignment assembly also includes an alignment body which is threadingly engaged to the alignment mandrel.

6. The multilateral access system according to claim 1, wherein the inner string is comprised of, from a top of the inner string to a bottom of the inner string, a tubular section, an anchor mandrel, a spacer joint, a floating seal mandrel with a sealing stack, and a rotating tunic shoe assembly.

7. A method for accessing for a multilateral well including a main well bore and at least one lateral well bore, comprising:

positioning a tubular workstring including an inner string and an outer string within a multilateral bore, the outer string including a diverter body having a cylindrical housing with a lateral window, the diverter body being shaped and dimensioned to direct the inner string through the lateral window and into the at least one lateral well bore;

positioning the diverter body such that the window of the diverter body faces a milled casing window of the lateral well bore;

moving the inner string upwardly above the diverter body and subsequently lowering the inner string back though the diverter body, wherein the diverter body exerts a lateral force on a lower end of the inner string urging the lower end of the inner string toward the milled casing window wherein an indexing alignment assembly ensures the window of the diverter body faces the same direction relative to the indexing alignment as a whipstock used to create an original lateral well bore and wherein the indexing alignment assembly includes an alignment mandrel, a lock ring threadingly engaged to the alignment mandrel.

8. The method according to claim 7, wherein the diverter body includes a spring device biasing the inner string toward the lateral window of the diverter body.

9. The method according to claim 8, wherein the spring device is composed of a series of leaf springs which, as the inner string passes therethrough, function to urge the inner string outward towards and through the lateral window and into the lateral well bore.

10. The method according to claim 7, wherein the indexing alignment assembly also includes an index ring slidingly engaged to the alignment mandrel, and a key engaged with the index ring into a slot in the alignment mandrel which permits axial sliding of the index ring but prevents rotation.

11. The method according claim 10, wherein the indexing alignment assembly also includes an alignment body which is threadingly engaged to the alignment mandrel.

12. The method according to claim 7, further including disengaging the inner string and the outer string.

13. The method according to claim 7, further including the step of positioning the window of the diverter body in a blank casing such that inner string may bypass the lateral well bore.

* * * * *

UNITED STATES PATENT AND TRADEMARK OFFICE

CERTIFICATE OF CORRECTION

PATENT NO. : 8,590,608 B2
APPLICATION NO. : 13/162072
DATED : November 26, 2013
INVENTOR(S) : Bryan Charles Linn and David Speller It is certified that error appears in the above-identified patent and that said Letters Patent is hereby corrected as shown below:

In the Claims

Column 13, line 9, claim 6, cancel the text beginning with "6. The multilateral access" to and ending "shoe assembly", and insert the following claim:

--6. The multilateral access system according to claim 1, wherein the inner string is comprised of, from a top of the inner string to a bottom of the inner string, a tubular section, an anchor mandrel, a spacer joint, a floating seal mandrel with a sealing stack, and a rotating mule shoe assembly.--

Signed and Sealed this
Fourth Day of February, 2014

Michelle K. Lee

Michelle K. Lee
*Deputy Director of the United States Patent and Trademark Office*